US007852311B2

(12) United States Patent
Hashimoto

(10) Patent No.: US 7,852,311 B2
(45) Date of Patent: Dec. 14, 2010

(54) LIQUID CRYSTAL DISPLAY AND DRIVE CIRCUIT THEREOF

(75) Inventor: Yoshiharu Hashimoto, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 0 days.

(21) Appl. No.: 12/509,066

(22) Filed: Jul. 24, 2009

(65) Prior Publication Data

US 2009/0284516 A1 Nov. 19, 2009

Related U.S. Application Data

(62) Division of application No. 11/404,937, filed on Apr. 17, 2006.

(30) Foreign Application Priority Data

Apr. 18, 2005 (JP) ..... 2005-119818
Nov. 30, 2005 (JP) ..... 2005-346689

(51) Int. Cl.
*G09G 3/36* (2006.01)

(52) U.S. Cl. ..... 345/100; 345/98

(58) Field of Classification Search ..... 345/87, 345/98–100, 94–96, 103, 204, 690
See application file for complete search history.

(56) References Cited

U.S. PATENT DOCUMENTS 6,049,321 A * 4/2000 Sasaki ..... 345/99
6,069,605 A * 5/2000 Ozawa ..... 345/98
6,144,354 A * 11/2000 Koyama et al. ..... 345/98
6,201,523 B1 * 3/2001 Akiyama et al. ..... 345/96
6,373,459 B1 * 4/2002 Jeong ..... 345/100
6,518,708 B2 * 2/2003 Aso ..... 315/169.1
7,151,516 B2 * 12/2006 Takeda et al. ..... 345/87
7,330,180 B2 * 2/2008 Inada ..... 345/204
7,423,624 B2 * 9/2008 Nose ..... 345/100
2003/0006997 A1 * 1/2003 Ogawa et al. ..... 345/690
2003/0112386 A1 * 6/2003 Bu ..... 349/96
2004/0041773 A1 * 3/2004 Takeda et al. ..... 345/98
2004/0104880 A1 * 6/2004 Kang et al. ..... 345/94
2004/0125067 A1 * 7/2004 Kim et al. ..... 345/98
2005/0007324 A1 * 1/2005 Inada ..... 345/87
2005/0110738 A1 * 5/2005 Kim et al. ..... 345/100
2005/0128113 A1 * 6/2005 Kim ..... 341/138

(Continued)

FOREIGN PATENT DOCUMENTS

JP 5-19725 A 1/1993

(Continued)

*Primary Examiner*—Ricardo L Osorio
(74) *Attorney, Agent, or Firm*—Sughrue Mion, PLLC

(57) ABSTRACT

A liquid crystal display of this invention includes a plurality of scan lines, a plurality of data lines, and pixels provided at each intersection of the plurality of scan lines and the plurality of data lines. The liquid crystal display further includes a plurality of pixel groups constituted of the pixels provided at each intersection of the consecutive plurality of data lines and one of the plurality of scan lines, in which signals of the same polarity are outputted to all data lines included in each of the plurality of pixel groups by a time-sharing drive that sequentially outputs signals, and reversed polarity signals are outputted to the plurality of pixel groups adjacent to each other, so that signals with polarities inverted after each frame are outputted to the data lines included in the pixel groups.

10 Claims, 20 Drawing Sheets

U.S. PATENT DOCUMENTS

| | | | | |
|---|---|---|---|---|
| 2005/0128169 | A1* | 6/2005 | Kang et al. | 345/87 |
| 2005/0140625 | A1* | 6/2005 | Kim et al. | 345/89 |
| 2005/0206629 | A1* | 9/2005 | Tseng et al. | 345/204 |
| 2006/0061532 | A1* | 3/2006 | Hashimoto | 345/89 |
| 2006/0077164 | A1* | 4/2006 | Ahn | 345/94 |
| 2008/0170027 | A1* | 7/2008 | Kyeong et al. | 345/100 |

FOREIGN PATENT DOCUMENTS

| | | | |
|---|---|---|---|
| JP | 8-129362 | A | 5/1996 |
| JP | 10-62744 | A | 3/1998 |
| JP | 2001-515225 | A | 9/2001 |
| JP | 2002-268613 | A | 9/2002 |
| JP | 2002-333863 | A | 11/2002 |
| JP | 2003-270660 | A | 9/2003 |
| JP | 2003-271105 | A | 9/2003 |
| JP | 2004-258485 | A | 9/2004 |

* cited by examiner

| | R1 | G1 | B1 | R2 | G2 | B2 | | | | | | |
|---|---|---|---|---|---|---|---|---|---|---|---|---|
| Y1 | R + | G + | B + | R − | G − | B − | R + | G + | B + | R − | G − | B − |
| Y2 | R − | G − | B − | R + | G + | B + | R − | G − | B − | R + | G + | B + |
| Y3 | R + | G + | B + | R − | G − | B − | R + | G + | B + | R − | G − | B − |

LIQUID CRYSTAL DISPLAY AND DRIVE CIRCUIT THEREOF

This application is a divisional application of U.S. application Ser. No. 11/404,937 filed Apr. 17, 2006 which claims priority based on Japanese Patent Application Nos. 2005-119818 filed Apr. 18, 2005 and 2005-346689 filed Nov. 30, 2005. The entire disclosures of the prior applications are hereby incorporated by reference.

BACKGROUND OF THE INVENTION

1. Field of the Invention

The present invention relates to a liquid crystal display and a drive circuit thereof that is suitable for placing a data line drive circuit having D/A conversion circuits only on one side of a panel for dot inversion drive.

2. Description of Related Art

In a well-known liquid crystal display, a polarity of a voltage applied from a data line to a pixel via a TFT (hereinafter referred to as a pixel voltage) is inverted after each prescribed period. That means that pixels are AC driven. The polarity here indicates a positive or negative polarity of a pixel voltage with respect to a voltage of a common electrode of the liquid crystals (com voltage) as a reference. Such a drive method uses for inhibiting the degradation of liquid-crystal material.

For the drive method, there are known methods such as dot inversion drive method and 2H dot inversion method. In the dot inversion drive method, polarities of pixel voltages are inverted by adjacent data lines and scan lines so that adjacent pixels have different polarities each other. In 2H dot inversion drive method, polarities of pixel voltages are inverted by each adjacent data line and by two scan lines. These drive methods help reduce flicker, thereby improving picture quality.

Japanese Unexamined Patent Application Publication No. 8-129362 discloses a circuit in which one D/A conversion circuit drives a plurality of data lines in a time-sharing manner. In the drive circuit disclosed in this technique, odd-numbered data lines are connected to an upper data line drive circuit, while even-numbered data lines are connected to a lower data line drive circuit. In a given horizontal period (also referred to as a scanning period), a positive polarity analog video signal is outputted from the upper data line drive circuit at the same time when a negative polarity analog video signal is outputted from the lower data line drive circuit. Then, during a next horizontal period, a negative polarity analog video signal is outputted from the upper data line drive circuit at the same time when a positive polarity analog video signal is outputted from the lower data line drive circuit. This is how the dot inversion drive method is achieved. The drive circuit further includes an initialization circuit for initializing data lines to a com voltage during a horizontal blanking period, in order to drive in a time-sharing manner by controlling writing time and order. A gradation voltage provided from outside the data line drive circuit is inverted by each horizontal period. Therefore switch groups for selecting gradation voltage are constituted of high-voltage devices. Japanese Unexamined Patent Application Publication No. 2004-258485 discloses a configuration for RGB time-sharing drive.

However we have now discovered that there are some problems in the conventional circuit described as above. A first problem is that an area is required for placing data line drive circuits on an upper and a lower side of a panel. This causes a size of the panel to be larger. Consequently the number of panel to be retrieved from one sheet of mother glass is reduced. Moreover a larger area is needed for a flexible substrate wiring that supplies signals and power to the data line drive circuits.

A second problem is that a circuit area is expanded because switch groups for selecting gradation voltage are constituted of high-voltage devices. Having a high power supply voltage usually requires withstand pressure of devices constituting a circuit to be high. For this reason, a thicker gate oxide film Tox and a longer gate length L are needed, requiring a larger circuit area.

SUMMARY OF THE INVENTION

According to an aspect of the present invention, there is provided a liquid crystal display that includes a plurality of scan lines, a plurality of data lines, a plurality of pixels provided at each intersection of the plurality of scan lines and the plurality of data lines, a plurality of pixel groups comprised of the plurality of pixels, and a drive circuit driving the plurality of scan lines and the plurality of data lines, wherein one of the plurality of pixel groups is comprised of some of the plurality of pixels provided at each intersection of some of the plurality of data lines and a scan line, and the drive circuit output signals of one polarity to all data lines contained in each of the plurality of pixel groups by a time-sharing drive, alternated polarity signals to the plurality of pixel groups adjacent to each other, and polarities of signals which are inputted to the data lines included in the plurality of pixel groups are inverted every each frame.

According to another aspect of the present invention, there is provided a drive circuit of a liquid crystal display that outputs positive polarity analog video signals and negative polarity analog video signals with different polarities in regard to a reference voltage to data lines of a liquid crystal display, in which the positive analog video signal is consecutively outputted to a first plurality of data lines in time-sharing manner during a prescribed period of a horizontal period, and the negative polarity analog video signal is consecutively outputted to a second plurality of data lines in a time-sharing manner during the prescribed period.

According to yet another aspect of the present invention, there is provided a drive circuit of a liquid crystal display that includes a positive polarity drive circuit formed on a first continuous region on a substrate for outputting a positive polarity analog video signal to an output terminal of a display unit, a positive polarity precharge circuit that is provided between the positive polarity drive circuit and the output terminal, for precharging a data line of the display unit near a reference voltage before a polarity of the data line changes into a negative polarity with different polarity from the positive polarity relative to the reference voltage, a negative polarity drive circuit formed on a second continuous region different from the first continuous region on the substrate, for outputting the negative polarity analog video signal to the output terminal, and a negative polarity precharge circuit provided between the negative polarity drive circuit and the output terminal, for precharging the data line near the reference voltage before a polarity of the data line changes from the negative polarity to the positive polarity.

The present invention reduces a size of a data line drive circuit in a liquid crystal display.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purpose.

First Embodiment

Figure 1:
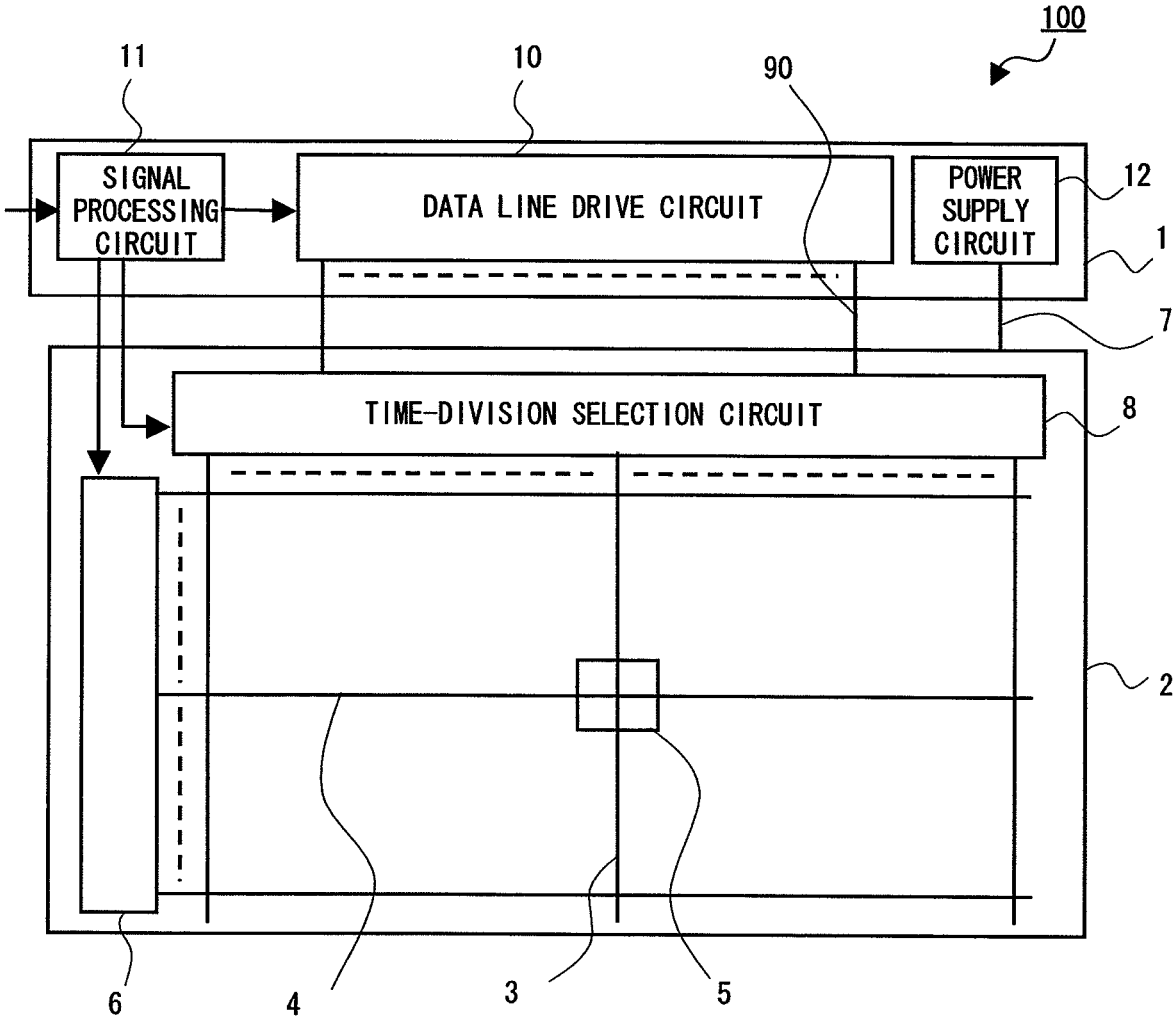
FIG. 1 is a block diagram showing a liquid crystal display according to a first embodiment of the present invention.

FIG. 1 is a block diagram showing a liquid crystal display 100 of this embodiment. The liquid crystal display 100 of this embodiment includes a plurality of scan lines 4, a plurality of data lines 3, and pixels 5 provided at each intersection of the plurality of scan lines 4 and the plurality of data lines 3. The liquid crystal display 100 further includes a plurality of pixel groups comprised of pixels 5 which is provided at each intersection of the consecutive plurality of data line 3 and one of the plurality of scan lines 4. Signals of the same polarity are outputted to all data lines included in each of the plurality of pixel groups by a time-sharing drive that sequentially outputs signals, and reversed polarity signals are outputted to the plurality of pixel groups adjacent to each other, and signals with inversed polarity are outputted to the data lines included in the pixel groups.

That is, as illustrated in FIG. 1, a plurality of data lines 3 and a plurality of scan lines 4 are formed on a substrate 2 of a liquid crystal panel, in a way that the plurality of scan lines 4 are placed orthogonal to the plurality of data lines 3. At each intersection of the data line 3 and the scan line 4, a TFT (Thin Film Transistor) as a switching device and a pixel 5 including a liquid crystal are formed. A display electrode and a common electrode that apply an electric field to a liquid crystal are formed in the pixel 5. An analog video signal for controlling a pixel luminance (amount of optical transmission) is provided to the display electrode from the data line 3, while a com voltage of a DC voltage is provided to the common electrode from a common electrode line 7. Furthermore on a substrate 2, there are formed a scan line drive circuit 6 that drives scan lines 4 and a time-sharing selection circuit 8 that converts analog video signals provided from a data line 90 of the data line drive circuit 10 in time-sharing manner.

Further, a driver IC1 is placed only on one side of the substrate 2, on which the data line drive circuit 10 as a drive circuit, a signal processing circuit 11, and a power supply circuit 12 are mounted. The data line drive circuit 10 provides an analog video signal to the data line 3 and the pixel 5 in response to a digital video signal. As stated in the foregoing, the data line drive circuit 10 is placed only on one side of the substrate 2. Considering an output voltage accuracy of an analog video signal outputted from a D/A conversion circuit, which is described later, it is preferable to integrate the data line drive circuit 10 as the driver IC1 on a semiconductor substrate such as silicon having a high relative precision. It is also preferable to integrate the signal processing circuit 11 on a semiconductor substrate that allows easy multi-layer wirings because the signal processing circuit 11 is automatically laid out using a macro block.

Figure 2:
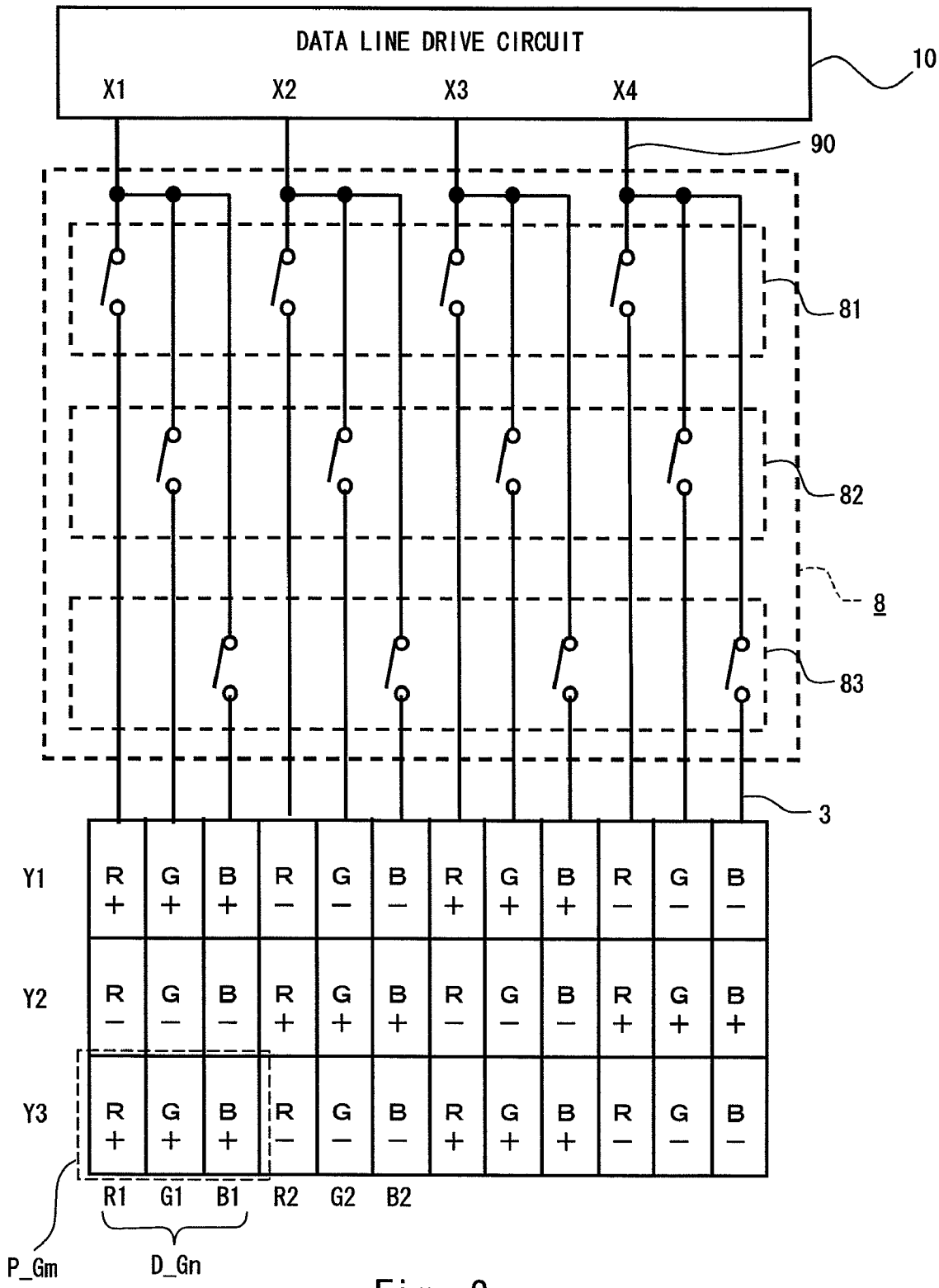
FIG. 2 is a detailed diagram showing a time-sharing selection circuit 8 according to the first embodiment of the present invention.

FIG. 2 is a detailed diagram showing a time-sharing selection circuit 8, which is a part of a drive circuit of a liquid crystal display of this invention. For an output terminal Xn (data line 90), three of the data lines 3 are connected via time-sharing switches 81, 82, and 83. Although this example drives by dividing into three, the number of division may be four or more. Note however that if the number of division is four when a display unit is three colors, each RGB signals making up a color can be split off. In such a case, each RGB signals constituting a color passes through different paths. That induces a subtle difference due to characteristics of the paths, affecting to generate a gap in a balance among RGB and consequently causing color shading. With a fact that a display unit for making up a color is three colors of RGB, and the number of pixels constituting a display unit is three, it is preferable to divide by a multiple numbers of three, such as 6 or 9.

In this embodiment, pixels and data lines that are outputted from one output terminal Xn of the data line drive circuit 10 and supplied with analog video signals divided by the time-sharing circuit 8 are respectively defined as a pixel group and a data line group. In FIG. 2, three data lines for R1, G1, and B1 are referred to as one data line group, D_Gn, furthermore a data line group for each lines of Y1, Y2, and Y3 is referred to as a pixel group P_Gm.

As described above, the time-sharing selection circuit 8 is formed on the substrate 2, and controlled by the signal processing circuit 11 inside the driver IC1. A control circuit of the time-sharing selection circuit 8 may be formed on the substrate 2, it is preferable to directly use the signal processing circuit 11 inside the driver IC1, so that a synchronization of a control signal with the data line drive circuit 10 is easier.

The power supply circuit 12 is described hereinafter in detail. The power supply circuit 12 generates a voltage from a DC power supply VDC that is supplied from outside of the driver IC1 for supplying the voltage to the data line drive circuit 10 and the scan line drive circuit 6. The power supply circuit 12 is comprised of a DCDC converter, irregulator and so forth, generating a positive polarity high power supply voltage VPH, a negative polarity low power supply voltage VNL for the data line drive circuit 10 and positive polarity high power supply voltage VPH, negative polarity low power supply voltage VNL for the scan line drive circuit 6. A positive polarity low power supply voltage and a negative polarity high power supply voltage for the data line drive circuit 10 is hereinafter referred to as system ground GND, where VPH=5V, VNL=−5V, VGH=10V, and VGL=−10.

The power supply circuit 12 has higher mobility than the TFT formed on the substrate 2 because of output impedance characteristic of power supply. Accordingly it is preferable to integrate the power supply circuit 12 on a silicon substrate which allows easy multilevel wiring. In this embodiment, the circuit is integrated along with the above data line drive circuit 10 and the signal processing circuit 11 as the driver IC1.

The power supply circuit 12 also generates a voltage for a common electrode (com voltage) of liquid crystals. Com voltage can be a DC voltage higher than a low-level voltage of a negative polarity drive circuit, or a DC voltage lower than a high-level voltage of a positive polarity drive circuit. A feed through error is generated when switching off TFTs in a liquid crystal panel. To correct this error, a voltage for a common electrode of liquid crystals must be DC voltage such as −1V. An amount of feed through error differs depending on a panel. For instance if a TFT is n-type, feed through error tends to be negative, thus a fine-tuning in a range from GND to −2V would be required, for example. If a TFT is p-type, feed through error tends to be positive, thus a fine-tuning in a range from GND to +2V would be required. TFT hereinafter refers to n-type TFT as there are generally more n-type TFT than p-type TFT.

Com voltage may be generated by a buffer operating with a positive polarity high-level voltage VPH and a negative polarity low-level voltage VNL, and output a voltage from 2V to −2V as a com voltage. The buffer is formed from high-voltage devices. Although operating the buffer with GND and a negative voltage VNL inhibits GND voltage to be outputted, the buffer may be formed with middle-voltage devices if not guaranteeing a voltage adjustment range to GND.

Com voltage may be generated by a circuit with a simple configuration in which a resistance voltage dividing circuit is provided between GND and VNL, and a bypass condenser at a junction point of resistances.

Figure 3:
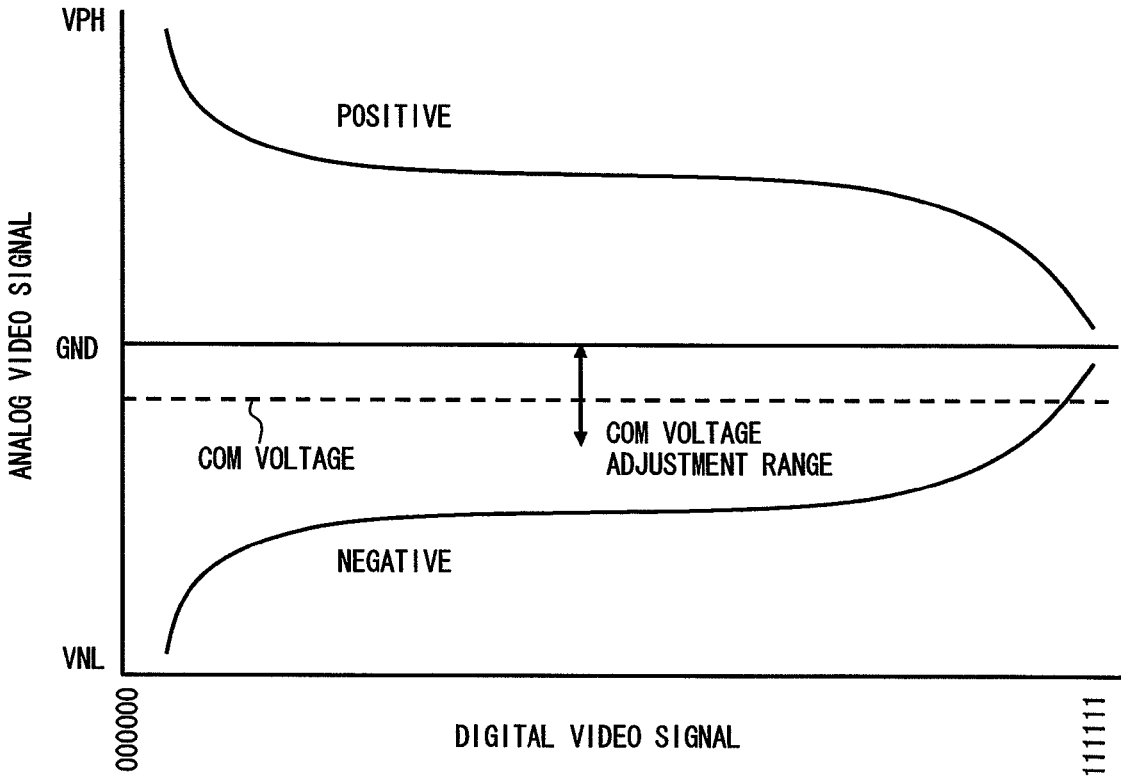
FIG. 3 is a correlation diagram between a digital video signal and an analog video signal according to the first embodiment of the present invention.

FIG. 3 shows a relationship between a positive gamma curve (Positive), a negative gamma curve (Negative) and a com voltage. Fine-tune the corn voltage in a range of −1±1V so that the positive gamma curve to be not less than GND as well as not more than VPH, while the negative gamma curve to be not less than VNL as well as not more than GND. Although the range of fine-tuning here is explained as ±1 for convenience, when the com voltage is generated with GND and the negative polarity low-level voltage VNL as described in the foregoing, the com voltage can be fine-tuned in that range. Adjusting the com voltage close to GND reduces the number of boosting a DCDC converter in the power supply circuit 12, improves an efficiency of the power supply circuit 12, and eventually reduces power consumption.

The signal processing circuit 11 is described hereinafter in detail. Signals to be inputted to the signal processing circuit 11 at least includes digital video signal Dx, clock signal CLK, vertical synchronizing signal Vsync, and horizontal synchronizing signal Hsync, with these signals generating desired timing signals such as start signal STH, latch signal STB, polarity signal POL, time-sharing switch controlling signal, and vertical start signal STV, in order to control each circuit in the data line drive circuit 10, time-sharing selection circuit 8, scan line drive circuit 6 and such. Since circuits on the substrate 2 are operated with power supply voltages of VGH and VGL, signals to be supplied to the substrate 2 provides signals of level-shifted VGH and VGL.

Figure 4:
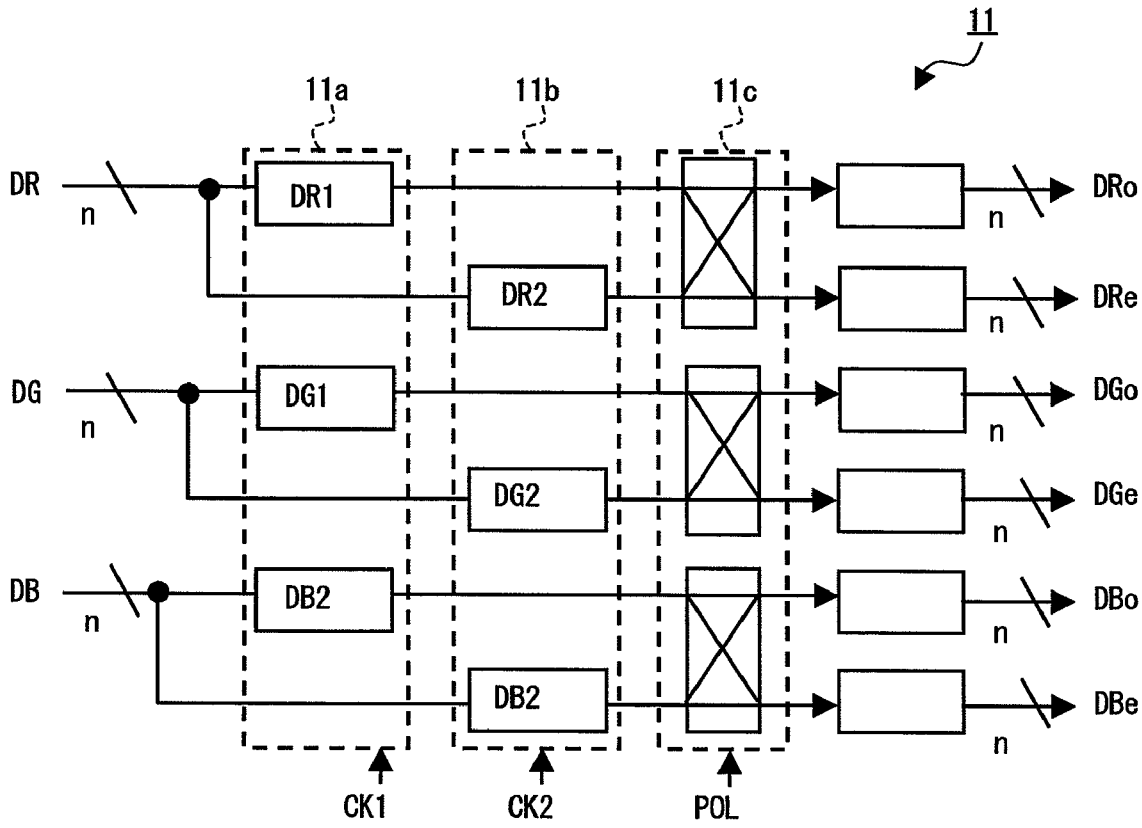
FIG. 4 is a detailed diagram showing a switching circuit for digital video signals according to the first embodiment of the present invention.

The signal processing circuit 11 includes latch circuits 11*a* and 11*b* for latching digital video signals Dx (DR, DG, and DB) respectively at timings of a clock CK1 and CK2, and a switching circuit 11*c* for switching between data buses DRo, DGo, DBo, and data buses DRe, DGe, DBe, depending on a polarity signal POL. As illustrated in FIG. 4, the signal processing circuit 11 first bundles two clocks of one pixel digital video signal Dx (DR, DG, and DB) supplied from outside, which makes two pixels (36 bits) in a latch circuit 11*a* and a latch circuit 11*b* before outputting to the data line drive circuit 10. As shown in the figure, a digital video signal Dx is outputted to the data buses DRo, DRe, DGo, DBo, and DBe. Moreover, the switching circuit 11*c* switches an output according to a polarity signal POL between the data buses DRo, DGo, DBo and the data buses DR2, DGe, and DBe. This is because an output to a data bus of a digital video signal Dx is replaced to correspond with a switch between a positive and negative analog video signal inside the data line drive circuit 10. By supplying two pixels to the data line drive circuit 10, a frequency for clock signals in the data line drive circuit 10 is cut down by half, as well as preventing high-frequency electromagnetic waves from being generated.

The data line drive circuit 10 of this invention outputs a positive polarity analog video signal and a negative polarity analog video signal to each output terminal Xn of the data line drive circuit 10 at the same time.

The positive and negative polarities here indicate a positive or a negative pixel voltage in regard to a voltage of a liquid crystal common electrode (com voltage) for liquid crystals as a reference. However in this embodiment, the positive and negative polarity indicates a positive or a negative polarity of a pixel voltage where the reference voltage is the system ground GND (0V).

Figure 5:
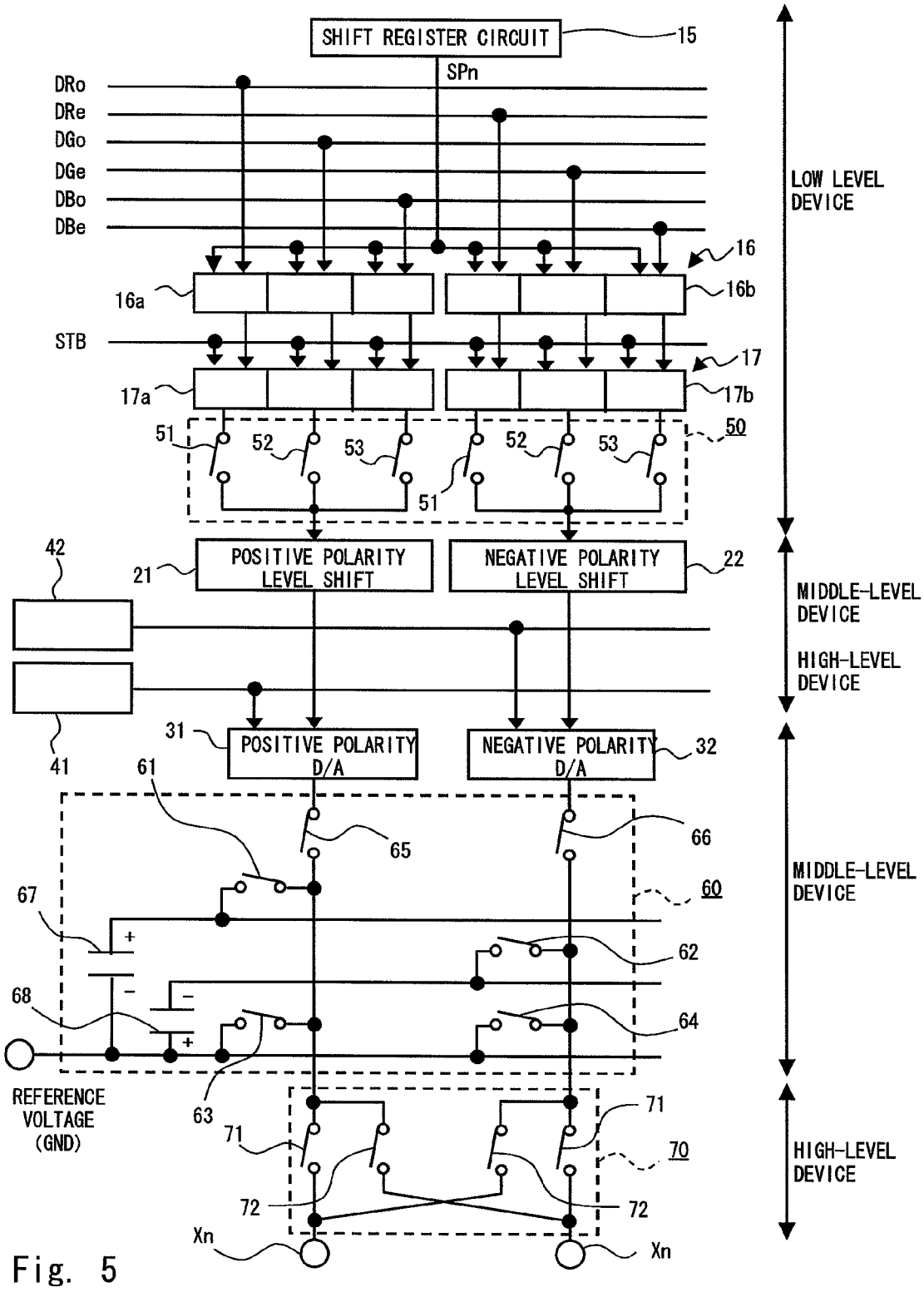
FIG. 5 is a block diagram showing a data line drive circuit 10 according to the first embodiment of the present invention.

FIG. 5 is a block diagram showing the data line drive circuit 10, hereinafter explaining configurations of each part in detail. The data line drive circuit 10 outputs positive polarity analog video signals and negative polarity analog signals with different polarity in regard to a reference voltage to data lines of the liquid crystal display 10. During a given period of a horizontal period, the data line drive circuit 10 consecutively outputs positive polarity analog video signals in a time-sharing manner to a first plurality of data lines at the same time when consecutively outputting negative polarity analog video signal in a time-sharing manner to a second plurality of data lines.

Therefore the data line drive circuit 10 is at least comprised of a data latch circuit 17, a positive polarity level shift circuit 21, a negative polarity level shift circuit 22, a positive polarity D/A conversion circuit 31, a negative polarity D/A conversion circuit 32, a positive polarity gradation voltage generating circuit 41, a negative polarity gradation voltage generating circuit 42, and a precharge circuit 60 as an output control portion. The data line drive circuit 10 may further include a digital video signal time-sharing circuit 50, a shift register circuit 15, a data register circuit 16, and a frame memory (not shown).

The data register circuit 16 includes a positive polarity data register circuit 16*a* and a negative polarity data register circuit 16*b*. The positive polarity data register circuit 16*a* is connected to the data buses of digital video signals Dx, which are DRo, DGo, and DBo. The positive polarity data register circuit 16*a* latches digital video signals from the data buses DRo, DGo, and DBo in response to sampling signals SPn that are inputted from the shift register circuit 15. The negative polarity data register circuit 16*a* is connected to the data buses of digital video signals Dx, which are DRe, DGe, and DBe. The positive polarity data register circuit 16*a* latches digital video signals from the data buses DRe, DGe, and DBe in response to sampling signals SPn that are inputted from the shift register circuit 15.

The data register circuit 16 is connected to a data latch circuit 17. The data latch circuit 17 includes a positive polarity data latch circuit 17*a* and a negative polarity data latch circuit 17*b*, once again latching the digital video signals Dx that are latched in the data register circuit 16. The data latch circuit 17 is connected to the digital video signal time-sharing circuit 50. The digital video signal time-sharing circuit 50 includes time-sharing switches 51, 52, and 53, chronologically and sequentially outputting a digital video signal Dx which is latched in the data latch circuit 17 by turning on and off the time-sharing switches 51, 52 and 53. The operation of time-sharing conducted by the digital video signal time-sharing circuit 50 is controlled by a control signal inputted from the signal processing circuit 11.

The precharge circuit 60 at least includes precharge switches 63 and 64 for precharging data lines to a reference voltage, D/A conversion circuits 31 and 32 and connecting switches 65 and 66 between output terminals Xn. In this embodiment, the precharge circuit 60 further includes charge recycling switches 61, 62 and charge recycling capacities 67 and 68, for driving with low power consumption. These switches are formed with medium-voltage devices, which are described later. It is preferable to provide the charge recycling capacities 67 and 68 outside the driver IC1 because the larger a capacity value, the higher a charge recycling effect would be. The charge recycling switch 61, the precharge switch 63, and the connecting switch 65 operate in a voltage range from GND to VPL (5V), while the charge recycling switch 62, the precharge switch 64, and the connecting switch 66 operates in a voltage range from VNL (−5V) to GND. Despite that these switches are provided to each of the output terminals Xn, they are controlled together by the signal processing circuit 11 through positive and negative polarity level shift circuits 21 and 22. The precharge switches 63 and 64 may be other than analog switches constituted of MOS transistors, for example pn junction devices such as diode.

A polarity switching circuit 70 is provided between the precharge circuit 60 and the output terminals Xn. The polarity switching circuit 70 includes polarity switching switches 71 and 72 for each output terminal Xn, selecting a positive or a negative analog video signal depending on a polarity signal POL. The polarity switching circuit 70 selects a positive polarity analog video signal for an odd-numbered output terminal Xn at the same time when selecting a negative polarity analog video signal for an even-numbered output terminal Xn. Alternatively, the polarity switching circuit 70 selects a negative polarity analog video signal for an odd-numbered output terminal Xn at the same time when selecting a positive polarity analog video signal for an even-numbered output terminal Xn. In this way, the selection is made so that the polarities of odd-numbered output terminals Xn and even-numbered output terminals Xn differ from each others. The polarity switching switch 71 and 72 are also controlled together by the signal processing circuit 11 via high voltage level shift circuits 21 and 22.

The gradation voltage generating circuits 41 and 42 are resistance voltage dividing circuit in which a plurality of resistances are connected in series, generating desired voltages so as to match gamma characteristics. In this invention, a positive polarity graduation voltage generations circuit 41 and a negative polarity graduation voltage generating circuit 42 are provided for simultaneously outputting a negative and a positive analog video signals, respectively having 64 positive polarity graduation voltages (VP0 to VP63) and 64 negative polarity gradation voltages (VN0 to VN63) and capable of outputting a plurality of gradation voltages fine-tuned for each RGB color in a time-sharing manner. There are two gradation voltage generating circuits 41 and 42 for positive and negative polarities, each storing correction values of RGB colors in fine-tuning registers and generating fine-tuned positive and negative gradation voltages.

A positive polarity D/A conversion circuit 31 outputs a positive polarity analog video signal relative to a reference voltage, in response to a digital video signal Dx. A negative polarity D/A conversion circuit 32 a negative polarity analog video signal relative to a reference voltage, in response to a digital video signal Dx. The positive polarity D/A conversion circuit 31 and the negative polarity D/A conversion circuit 32 are formed with middle-voltage devices, which are described later.

Figure 6:
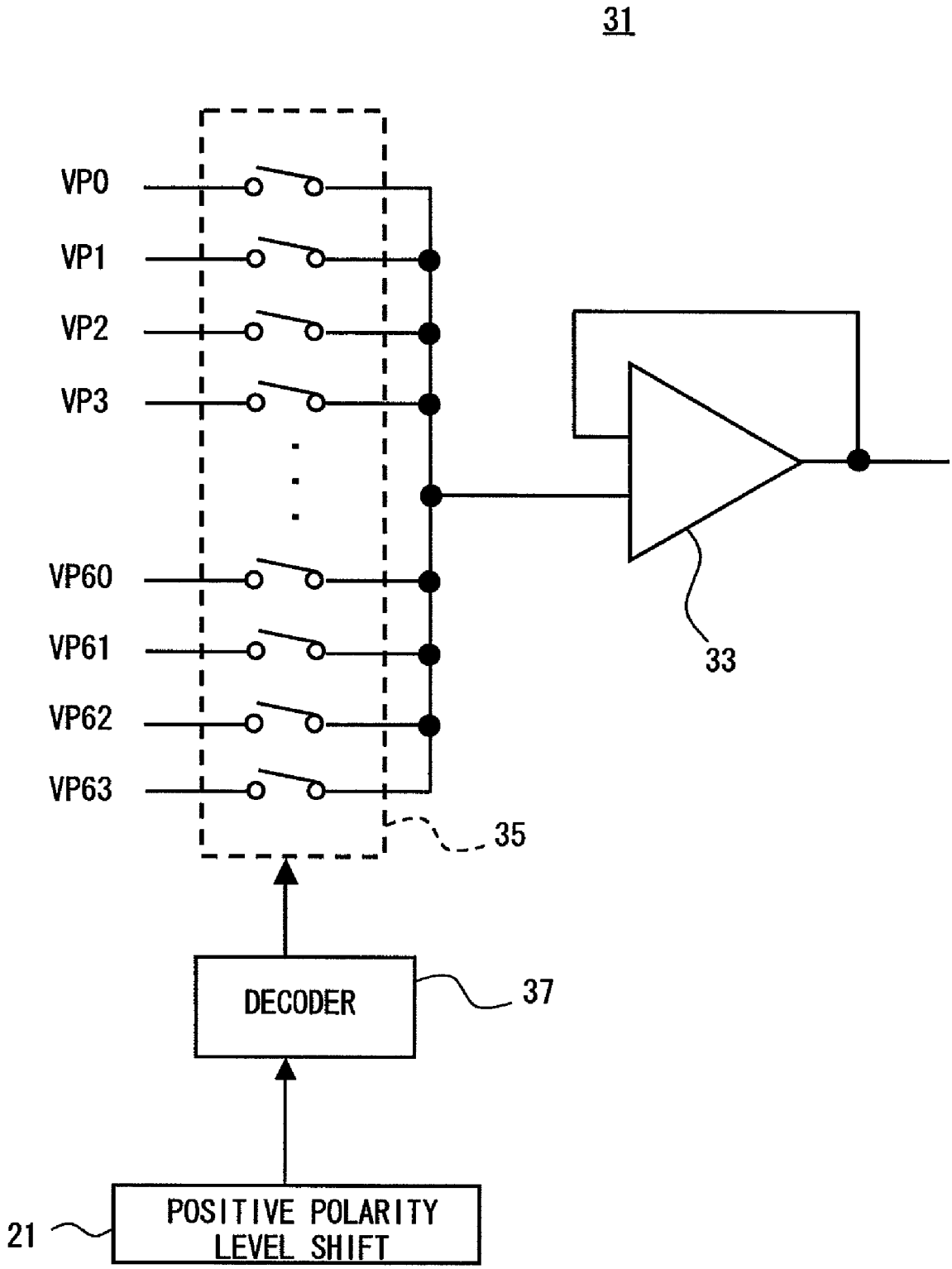
FIG. 6 is a detailed diagram showing a positive D/A conversion circuit 31 according to the first embodiment of the present invention.

FIG. 6 is a detailed diagram showing the positive D/A conversion circuit 31. The positive polarity D/A conversion circuit 31 is comprised of an amplifier 33, a selector 35 that includes 64 switches, and a decoder 37, each circuit operating in a voltage range from GND to VPL (5V). Positive polarity gradation voltages (VP0 to VP63) are supplied from the positive polarity gradation generating circuit 41 to each switch of the selector 35. One gradation voltage is selected by the decoder 37 from 64 positive polarity gradation voltages depending on a digital video signal Dx, and then the selected gradation voltage is outputted through the amplifier 33.

Figure 7:
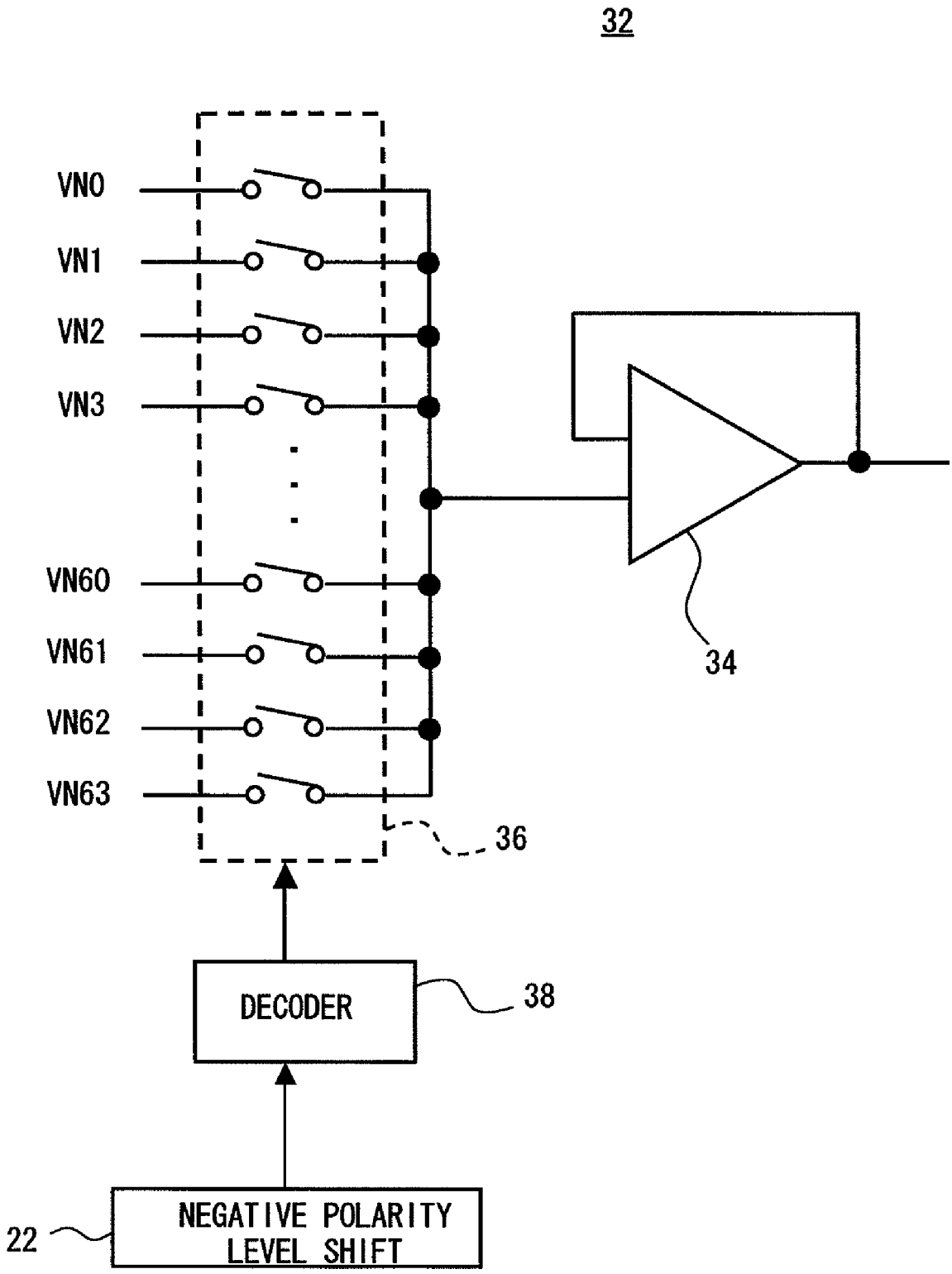
FIG. 7 is a detailed diagram showing a negative D/A conversion circuit 32 according to the first embodiment of the present invention.

FIG. 7 is a detailed diagram showing the negative polarity D/A conversion circuit 32. The negative polarity D/A conversion circuit 32 is comprised of an amplifier 34, a selector 36 that includes 64 switches, and a decoder 38, each circuit operating in a voltage range from VNL (−5V) to GND. Negative polarity gradation voltage (VN0 to VN63) is supplied from the negative polarity gradation generating circuit 42 to each switch of the selector 36. One gradation voltage is selected by the decoder 38 from 64 positive polarity gradation voltages, depending on a digital video signal Dx, and then the selected gradation voltage is outputted through the amplifier 34.

Logic parts of the signal processing circuit 11 and data latch circuit 17 and such are operating from GND to VDD (2.5V). Accordingly a positive polarity level shift circuit 21 and a positive negative level shift circuit 22 are provided between the data latch circuit 17 or the digital video signal time-sharing circuit 50, and the positive polarity D/A conversion circuit 31 and the negative polarity D/A conversion circuit 32. The positive level shift circuit 21 and the negative level shift circuit 22 are formed with middle-voltage devices and high-voltage devices, which are described later.

As described in the foregoing, the time-sharing selection circuit 8 connects the output terminals Xn of the data line drive circuit 10 with a plurality of data lines 3 via a plurality of switches. Specifically as shown in FIG. 2, time-sharing switches 81, 82, and 83 are provided between an output terminal X1 and data lines R1, G1, and B1. That is, time-sharing switches 81, 82, and 83 are provided between an output terminal Xn and data lines Rn, Gn, and Bn. The time-sharing drive circuit 8 operates in the same VGH and VGL power supply voltages of the scan line drive circuit 6.

To drive color display QVGA (240RGB×320) pixels in three division, 120 each of the positive polarity D/A conversion circuit 31 and negative polarity D/A conversion circuit 32 are provided to the driver IC1. In a six division driving, 60 each of the positive and negative polarity D/A conversion circuits are required. However only one each of the charge recycling capacities 67 and 68 need to be provided in a liquid crystal display. Circuit configuration can therefore be simplified by performing time-sharing operation to every positive and negative drive circuit and by inverting polarities by each data line group to be driven in a time-sharing manner.

An operation is described in detail hereinafter. When a horizontal start signal STH is inputted to the shift register circuit 15, a sampling signal SPn which is synchronized to an internal clock signal CK is generated in turn. A digital video signal Dx is latched to the data register circuit 16 in response to a sampling signal SPn. The digital vide signal Dx latched in the data register circuit 16 is latched in parallel to the data latch circuit 17 in response to an input of a latch signal STB. The data latch circuit 17 is connected to the positive polarity level shift circuit 21 or the negative polarity level shift circuit 22. The digital video signal Dx is inputted to the positive polarity D/A conversion circuit 31 or the negative polarity D/A conversion circuit 32 through the positive polarity level shift circuit 21 or the negative polarity level shift circuit 22. After that the digital video signal Dx is converted to a positive polarity analog video signal or a negative polarity analog video signal in a positive polarity D/A conversion circuit 31 or a negative polarity D/A conversion circuit. Then the positive or negative polarity analog video signal is supplied to each of the data line 3 through a polarity switching circuit 70 for selecting a positive or negative analog video signal depending on a polarity signal POL and the time-sharing selection circuit 8.

Figure 8:
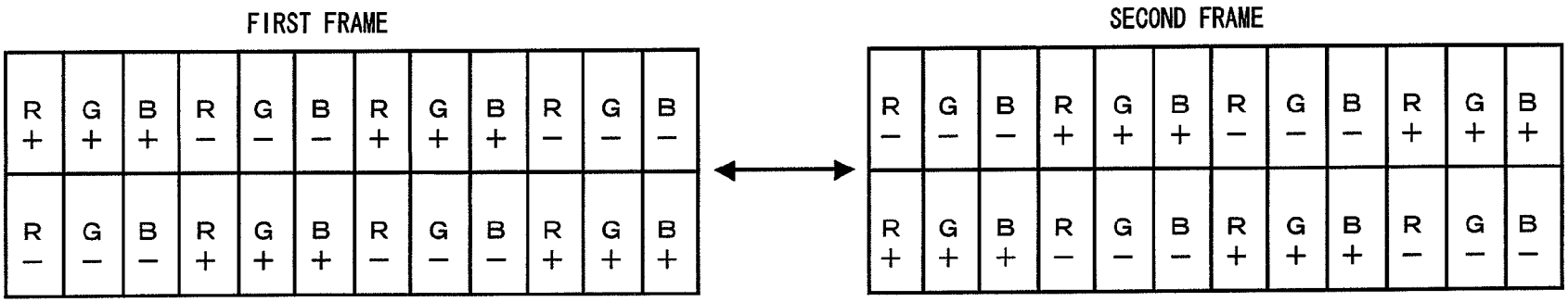
FIG. 8 is a schematic diagram showing a polarity of a pixel according to the first embodiment of the present invention.

Further detail of the operation is described hereinafter. To elucidate the explanation, the case will be considered where there are six data lines (R1, G1, B1, R2, G2, and B2) and two scanning lines (Y1, Y2), as shown in FIG. 8. Digital video signals corresponding to each data line (R1, G1, B1, R2, G2, B2) are represented by (DR1, DG1, DB1, DR2, DG2, DB2) respectively. Further, an example will be explained in which a RGB pixel inversion drive is conducted such that the polarity of each element in a first scanning line Y1 becomes (+, +, +, −, −, −) and a polarity of each element in a second scanning line Y2 becomes (−, −, −, +, +, +). As shown in FIG. 8, each pixel is driven so that the pixel is inverted after each frame.

A digital video signal is switched to match with a pixel to be displayed in the signal processing circuit 11 which is illustrated in FIG. 4. When a polarity signal POL is L, digital video signals (DR1, DG1, and DB1) are supplied to the data buses (DRo, DGo, and DBo), and then latched to the positive polarity data register circuit 16*a*. The digital video signals (DR2, DG2, and DB2) are supplied to the data buses (DRe, DGe, and DBe), and then latched to the negative polarity data register circuit 16*b*. On the other hand when a polarity signal POL is H, digital video signals (DR1, DG1, and DB1) are supplied to the data buses (DRe, DGe, and DBe), and then latched to the negative polarity data register circuit 16*b*. The digital video signals (DR2, DG2, and DB2) are supplied to the data buses (DRo, DGo, and DBo), and then latched to the positive polarity data register circuit 16*a*.

Figure 9:
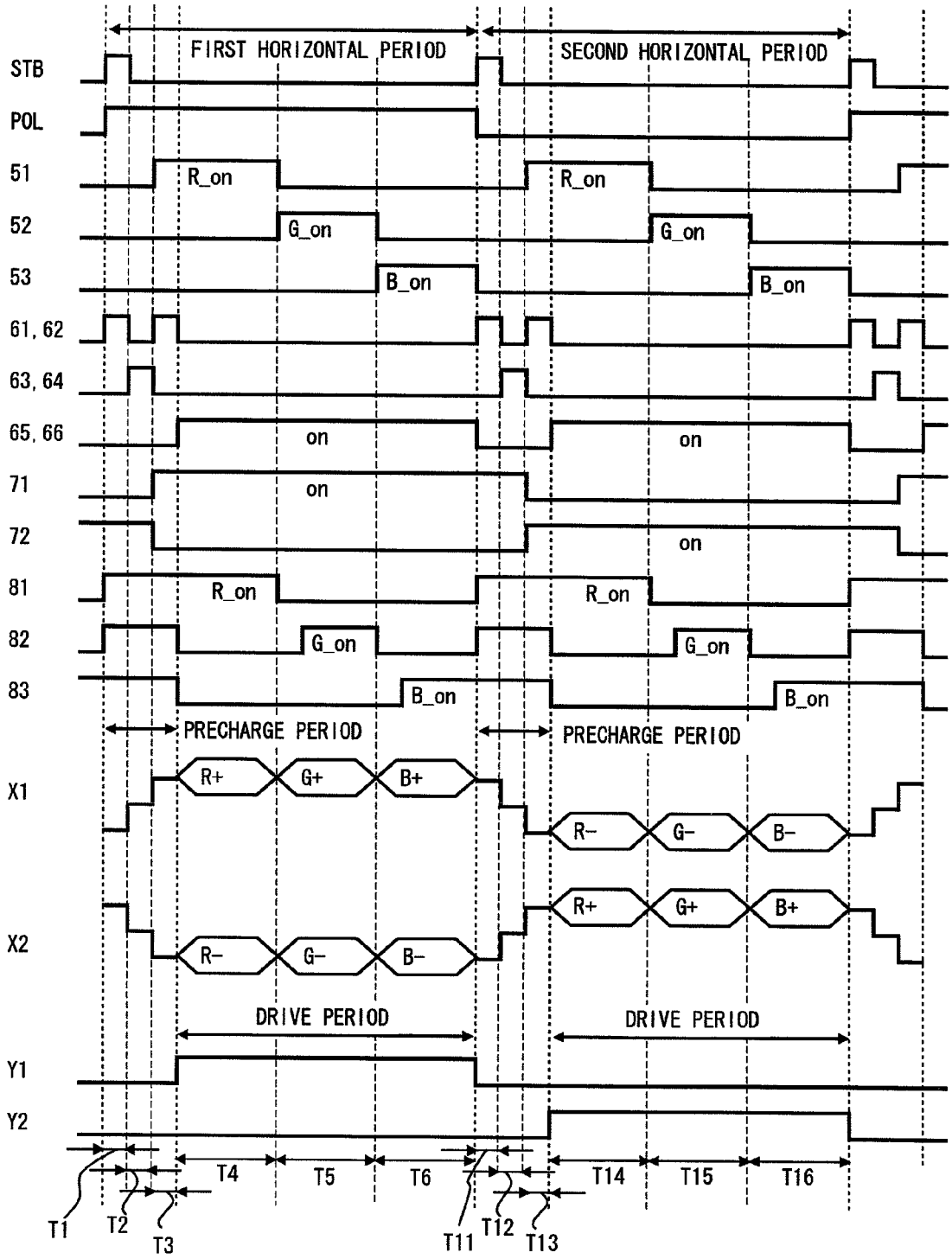
FIG. 9 is a timing chart according to the first embodiment of the present invention.
Figure 10A:
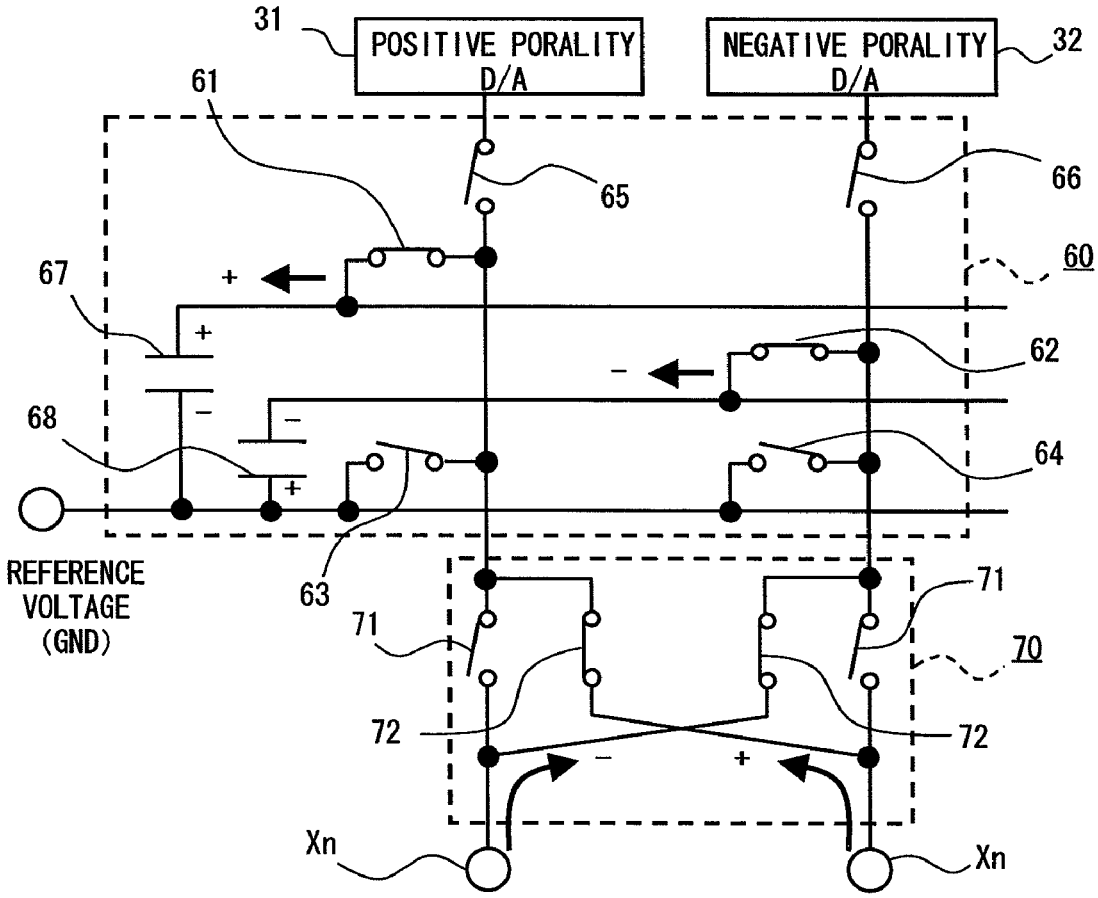
FIGS. 10A to 10D are detailed diagrams showing precharge operations according to the first embodiment of the present invention.

FIG. 9 is a timing chart showing operations of each part with control signals outputted from the signal processing circuit 11. According to the timing chart FIG. 9 and charge recycling operation schematic views FIGS. 10A to 10D, during the first precharge period T1 in a first horizontal period, charge recycling switches 61, 62, a polarity switching switch 72, time-sharing switches 81, 82, and 83 are turned on (as shown in FIG. 10A). Then positive polarity charges of data lines (R2, G2, and B2) which are driven to positive polarity in a previous horizontal period are charged to the charge recycling capacity 67, and similarly negative polarity charges of data lines (R1, G1, and B1) which are driven to negative polarity are charged to the charge recycling capacity 68.

The operation is further described in detail hereinafter. After a voltage is applied as a picture signal to the data line 3 via an output terminal Xn from a positive polarity D/A conversion circuit 31 and a negative polarity D/A conversion circuit 32, a charge is retained between TFT included in a pixel 5 from the positive polarity D/A conversion circuit 31 and the negative polarity D/A conversion circuit 32, until precharge switches 63 and 64 are closed. However after applying a voltage of a pixel signal to the data line 3 via an output terminal Xn, by leaving the polarity switching switches 71 and 72 as they are, closing the time-sharing switches 81, 82, and 83, and further closing the charge recycling switches 61 and 62, the charge retained in the data line 3 can be collected to the charge recycling capacities 67 and 68.

Figure 10B:
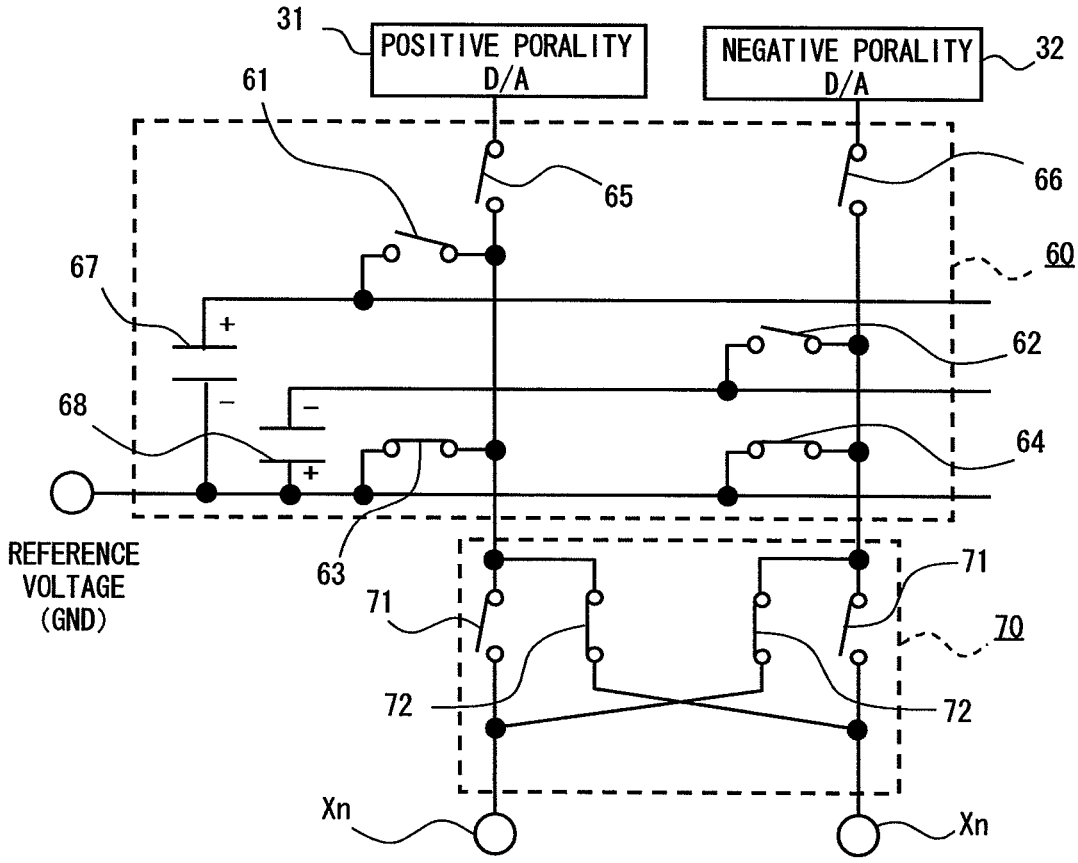

Then, during a second precharge period T2 in the first horizontal period, precharge switches 63, 64, polarity switching switch 72, time-sharing switches 81, 82, and 83 are turned on (as shown in FIG. 10B). Then the data lines 3 (R2, G2, and B2), which are driven to positive polarity in a previous horizontal period, are precharged to a reference voltage (GND), similarly the data lines 3 (R1, G1, and B1), which are driven to negative polarity to a reference voltage (GND), are precharged in order to neutralize them. At this time, the charge recycling switches 61 and 62 and precharged in a state in which they are opened, charges are retained in the charge recycling capacities 67 and 68.

Figure 10C:
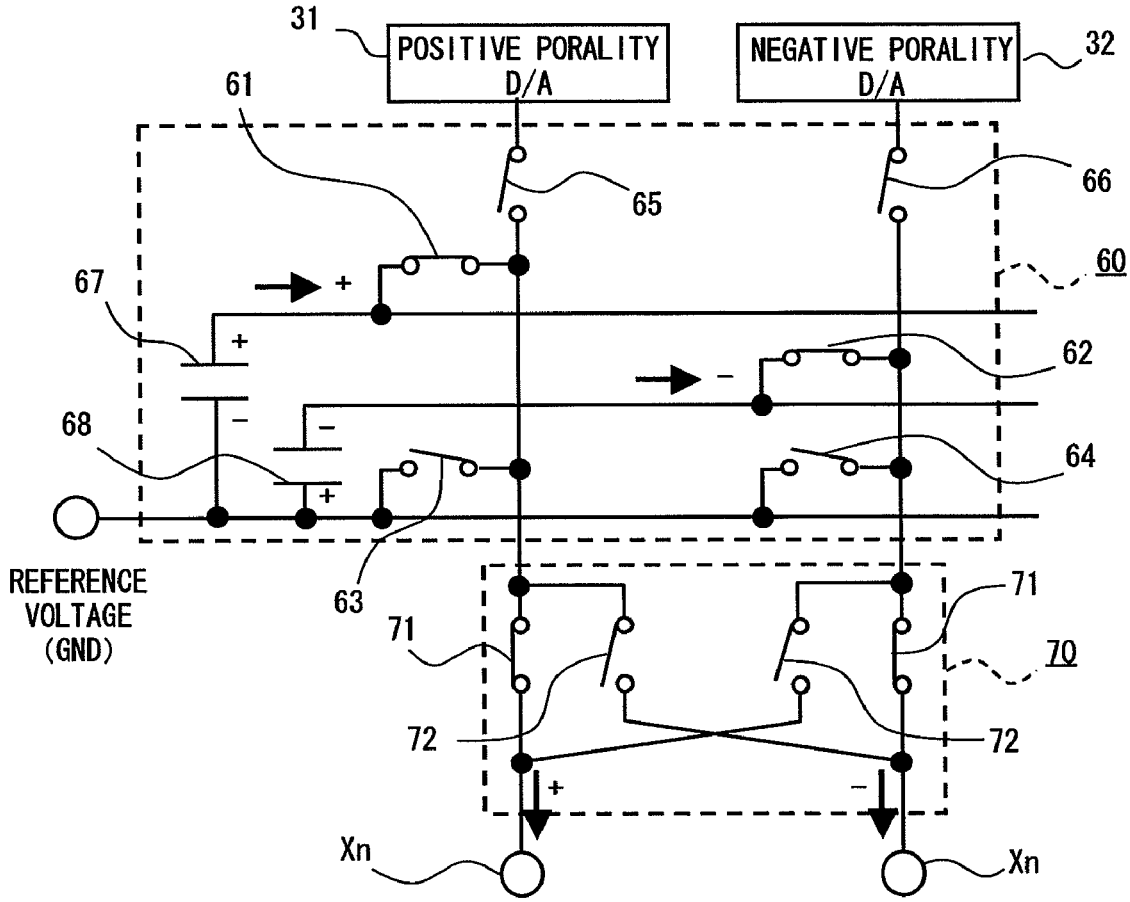

Then, during a third precharge period T3 in the first horizontal period, charge recycling switches 61, 62, polarity switching switch 71, time-sharing switches 81, 82, and 83 are turned on (as shown in FIG. 10C). Then positive polarity charges are discharged from the charge recycling capacity 67 to the data lines 3 (R1, G1, and B1) which are precharged to a reference voltage in the second precharge period T2, similarly negative polarity charges are discharged from the charge recycling capacity 68 to the data lines 3 (R2, G2, and B2). In other words, by switching the polarity switching switches 71 and 72 and discharging charges collected and retained in the charge recycling capacities 67 and 68 during the first precharge period T1, charges are discharged to other data lines 3 than data lines that have collected the charges. This operation realizes charge recycling and reduces a power consumption required for a voltage applied to data lines 3 as a pixel signal to reach a voltage applied by the positive polarity D/A conversion circuit 31 or the negative polarity D/A conversion circuit 32

Figure 10D:
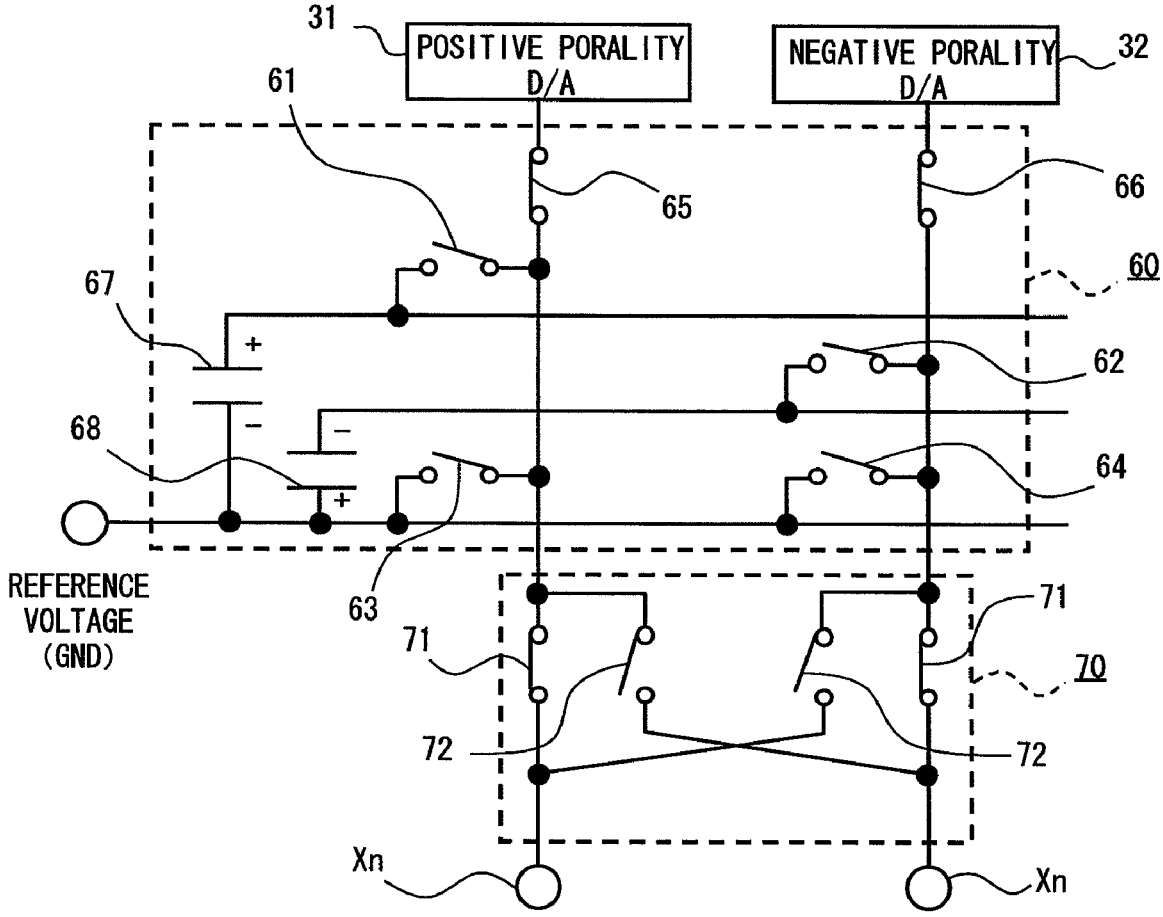

Then, during a drive period in the first horizontal period, by turning on connecting switches 65, 66, and the polarity switching switch 71 (as shown in FIG. 10D), an analog video signal is outputted to the data line 3. That is, during a first drive period T4 in the first horizontal period, connecting switches 65, 66, the polarity switching switch 71, and the time-sharing switch 81 are turned on, a positive polarity analog video signal is outputted from an output terminal X1 to a data line R1, and a negative polarity analog video signal is outputted from an output terminal X2 to a data line R2. Then, during a second drive period T5 in the first horizontal period, connecting switches 65, 66, the polarity switching switch 71, and the time-sharing switch 82 are turned on, a positive polarity analog video signal is outputted from the output terminal X1 to a data line G1, and a negative polarity analog video signal is outputted from the output terminal X2 to a data line G2. Then, during a third drive period T6 in the first horizontal period, connecting switches 65, 66, the polarity switching switch 71, and the time-sharing switch 83 are turned on, a positive polarity analog video signal is outputted from the output terminal X1 to a data line B1, and a negative polarity analog video signal is outputted from the output terminal X2 to a data line B2.

After that during a first precharge period T11 in a second horizontal period, charge recycling switches 61, 62, the polarity switching switch 71, time-sharing switches 81, 82, and 83 are turned on. Then positive polarity charges of the data line 3 (R1, G1, and B1) which are driven to positive polarity in the first horizontal period are charged to the charge recycling capacity 67, and similarly negative polarity charges of the data line 3 (R2, G2, and B2) which are driven to negative polarity in the first horizontal period are charged to the charge recycling capacity 68. Then, during a second precharge period T2 in the second horizontal period, precharge switches 63, 64, polarity switching switch 72, time-sharing switches 81, 82, and 83 are turned on. Then the data lines 3 (R1, G1, and B1), which are driven to positive polarity in the horizontal period, are precharged to a reference voltage (GND), similarly the data lines 3 (R2, G2, and B2), which are driven to negative polarity to a reference voltage (GND), are precharged in order to neutralize them. Then, during a third precharge period T13 in the second horizontal period, charge recycling switches 61, 62, polarity switching switch 72, time-sharing switches 81, 82, and 83 are turned on. Then positive polarity charges are discharged from the charge recycling capacity 67 to the data lines 3 (R2, G2, and B2) which are precharged to a reference voltage in the second precharge period T12, similarly negative polarity charges are discharged from the charge recycling capacity 68 to the data lines 3 (R1, G1, and B1). Then, during a third precharge period T13 in the second horizontal period, charge recycling switches 61, 62, polarity switching switch 71, time-sharing switches 81, 82, and 83 are turned on. After that positive polarity charges are discharged from the charge recycling capacity 67 to the data lines 3 (R2, G2, and B2) which are precharged to a reference voltage in the second precharge period T12, similarly negative polarity charges are discharged from the charge recycling capacity 68 to the data lines 3 (R1, G1, and B1).

Then, during a first drive period T14 in the second horizontal period, the connecting switches 65, 66, the polarity switching switch 71, and the time-sharing switch 81 are turned on, a negative analog video signal is outputted from the output terminal X1 to the data line R1, and a positive polarity analog video signal is outputted from an output terminal X2 to a data line R2. Then, during a second drive period T15 in the second horizontal period, the connecting switches 65, 66, the polarity switching switch 71, and the time-sharing switch 82 are turned on, a negative analog video signal is outputted from the output terminal X1 to the data line G1, and a positive polarity analog video signal is outputted from an output terminal X2 to a data line G2. Then, during a third drive period T16 in the second horizontal period, the connecting switches 65, 66, the polarity switching switch 72, and the time-sharing switch 83 are turned on, a negative analog video signal is outputted from the output terminal X2 to the data line B1, and a positive polarity analog video signal is outputted from an output terminal X2 to a data line B2.

According to the operations described in the foregoing, the positive polarity D/A conversion circuit 31, the charge recycling switch 61, precharge switch 63, and the connecting switch 65 are only applied with positive polarity voltages, while the negative polarity D/A conversion circuit 32, the charge recycling switch 62, precharge switch 64, and the connecting switch 66 are only applied with negative polarity voltages. Accordingly these devices can be formed with middle-voltage devices (5V), which is described later. With middle-voltage devices, a circuit area can be reduced with a thinner a gate oxide film and a shorter gate length.

To prevent flicker from being generated, restraining a fluctuation of com voltage is an effective way. As in this embodiment, even though pixels are not adjacent as with a R1 pixel and a R2 pixel, if a total charge amount of positive and negative polarity analog signals to be written to pixels are the same in one writing, positive and negative charges cancel out each other, resulting a subtle fluctuation of com voltage.

By a series of precharge operations, positive and negative polarity charges that are accumulated to data lines can be collected and recycled, creating 50% charge recycling effect at most as well as reducing power consumption.

An example of manufacturing a driver IC1 of this embodiment is described hereinafter in detail. In this embodiment, an example of manufacturing low-voltage devices that operates with low-voltage (2.5), middle-voltage devices that operates with middle-voltages (5V), and high-voltage devices that operates with high-voltage (20V) through diffusion processes. The above voltages are merely an example and can be other voltages as long as retaining a relationship of low voltage<middle voltage<high voltage. However there are middle-voltage devices used for positive polarity and for negative polarity, while high-voltage devices can be used for both of the voltage ranges.

Generally for a device like a transistor in a semiconductor integrated circuit, it is known that a device area becomes large when having a higher voltage. The relationships among a gate length Lmin, gate width Wmin, gate oxide film thickness Tox is; Lmin (low-voltage device)<Lmin (middle-voltage device)<LMin (high-voltage device), Wmin (low-voltage device)<Wmin (middle-voltage device)<Wmin (high-voltage device, and Tox (low-voltage device)<Tox (middle-voltage device)<Tox (high-voltage device). Therefore a chip size of a driver IC1 can be reduced by adopting a circuit configuration with as little high-voltage devices as possible.

In this embodiment, logic parts of the signal processing circuit 11 and the data latch circuit 17 and such are formed with low-voltage devices, the positive polarity D/A conversion circuit 31, the negative D/A conversion circuit 32, and the precharge circuit 60 are formed with middle-voltage devices, the polarity switching circuit 70, a part of the negative polarity level-shift circuit 22, and a part of the signal processing circuit 11 are formed with high-voltage devices. Because control signals to the scan line drive circuit 6 and the time-sharing selection circuit 8 are inputted via level-shift circuits, high-voltage devices are used for a part of the signal processing unit 11.

Figure 11:
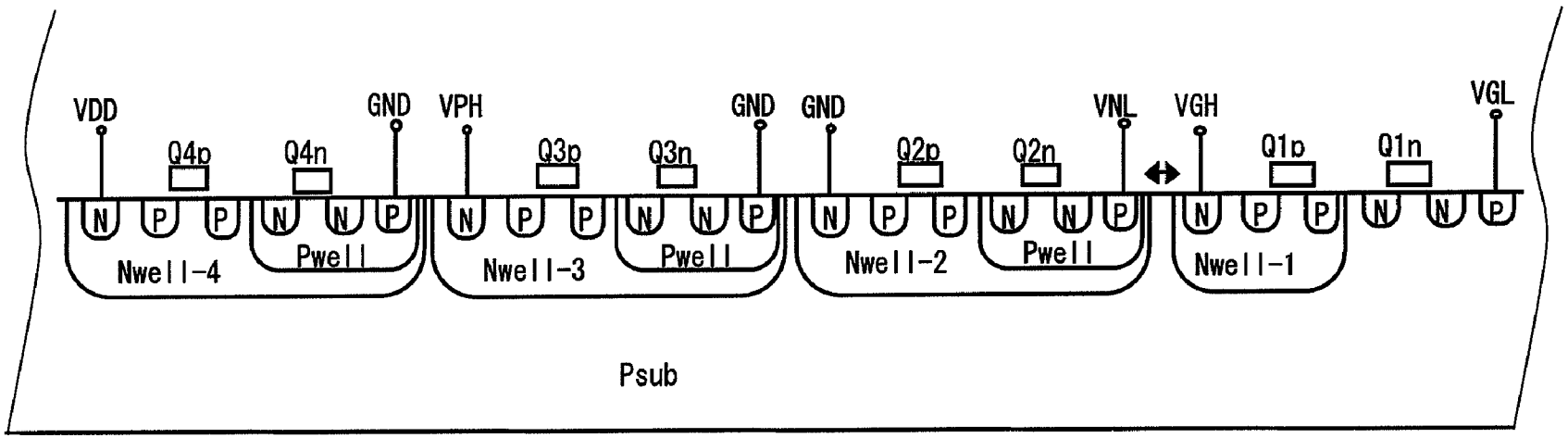
FIG. 11 is a cross-section diagram showing a semiconductor integrated circuit according to the first embodiment of the present invention.

FIG. 11 is a cross-section diagram showing a substrate and a configuration of devices on the substrate in a semiconductor integrated circuit. A n-type transistor and a p-type transistor formed with high voltage (20V) as a reference are respectively referred to as Q1*n* and Q1*p*, a n-type transistor and a p-type transistor on a Nwell-2 formed with middle voltage (5V) as a reference is respectively referred to as Q2*n* and Q2*p*, a n-type transistor and a p-type transistor on a Nwell-3 are respectively referred to as Q3*n* and Q3*p*, and a n-type transistor and a p-type transistor on a Nwell-4 formed with low voltage (2.5V) are respectively referred to as Q4*n* and Q4*p*.

With a voltage for a substrate (Psub) is at least VGL=−10, place a signal processing circuit 11 on the Nwell-4, place a positive polarity D/A conversion circuit 31 on the Nwell-3, a negative polarity D/A conversion circuit 32 on the Nwell 1-2, a polarity switching circuit 70, a part of a negative polarity level shift circuit 22, and a part of a signal processing circuit 11 are placed on the Psub and the Nwell-1. Although devices other than a transistor such as a resistance, condenser, and a diode are also provided in the driver IC1, withstand pressure for the devices are secured.

The data line drive circuit 10 includes a plurality of D/A conversion circuits for driving a plurality of data lines, each circuit being placed depending on an operation voltage to a continuous region of each Nwell. As several dozens μm are required between Nwells with different potentials, a size of a circuit having the same voltage range is reduced when placing such circuit in a continuous Nwell.

In this invention, the polarity switching circuit 70 is formed with high-voltage devices (20V). Accordingly a voltage for operating the polarity switching circuit 70 can be a voltage range between VGL=−10V and VPH=5V, VGL=−10V and VPH=10V and a voltage for Nwell-1 is defined as VPH=5 or VGH=10V.

Though the substrate is assumed as P-type semiconductor in this embodiment, the substrate may be n-type semiconductor (Nsub). In such a case, a voltage for Nsub will be at most VGH=10V.

Second Embodiment

Figure 12:
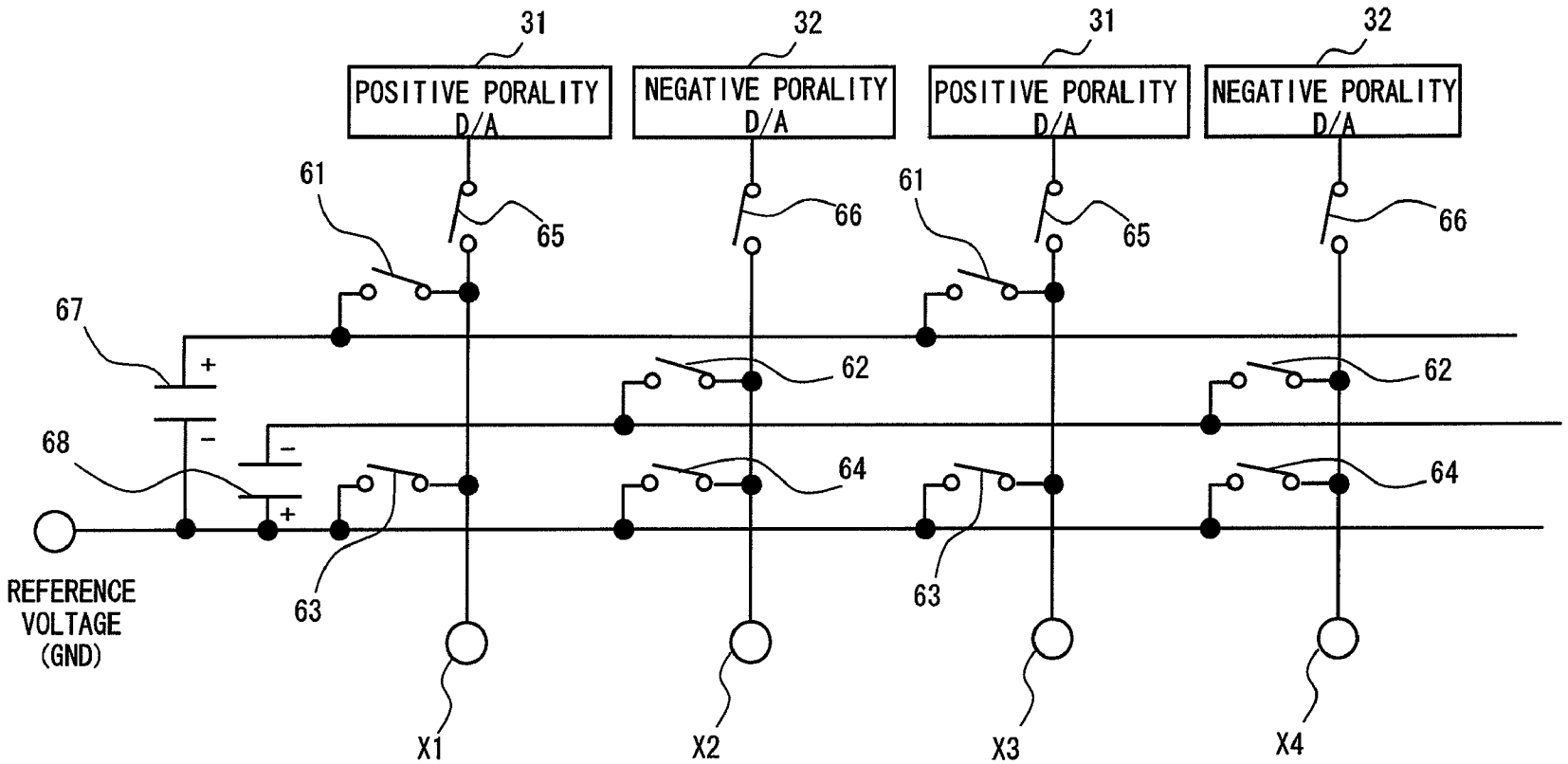
FIG. 12 is a detailed diagram showing an output portion of the data line drive circuit 10 according to a second embodiment of the present invention.

In the first embodiment, the polarity switching circuit 70 is formed on the driver IC1 and the time-sharing selection circuit 8 is formed on a panel. However a selection circuit having polarity switching function along with time-sharing switch function may be formed on the panel. FIG. 12 is a detailed diagram of a D/A conversion circuit portion and a precharge circuit portion of a driver IC1 according to this embodiment.

Figure 13:
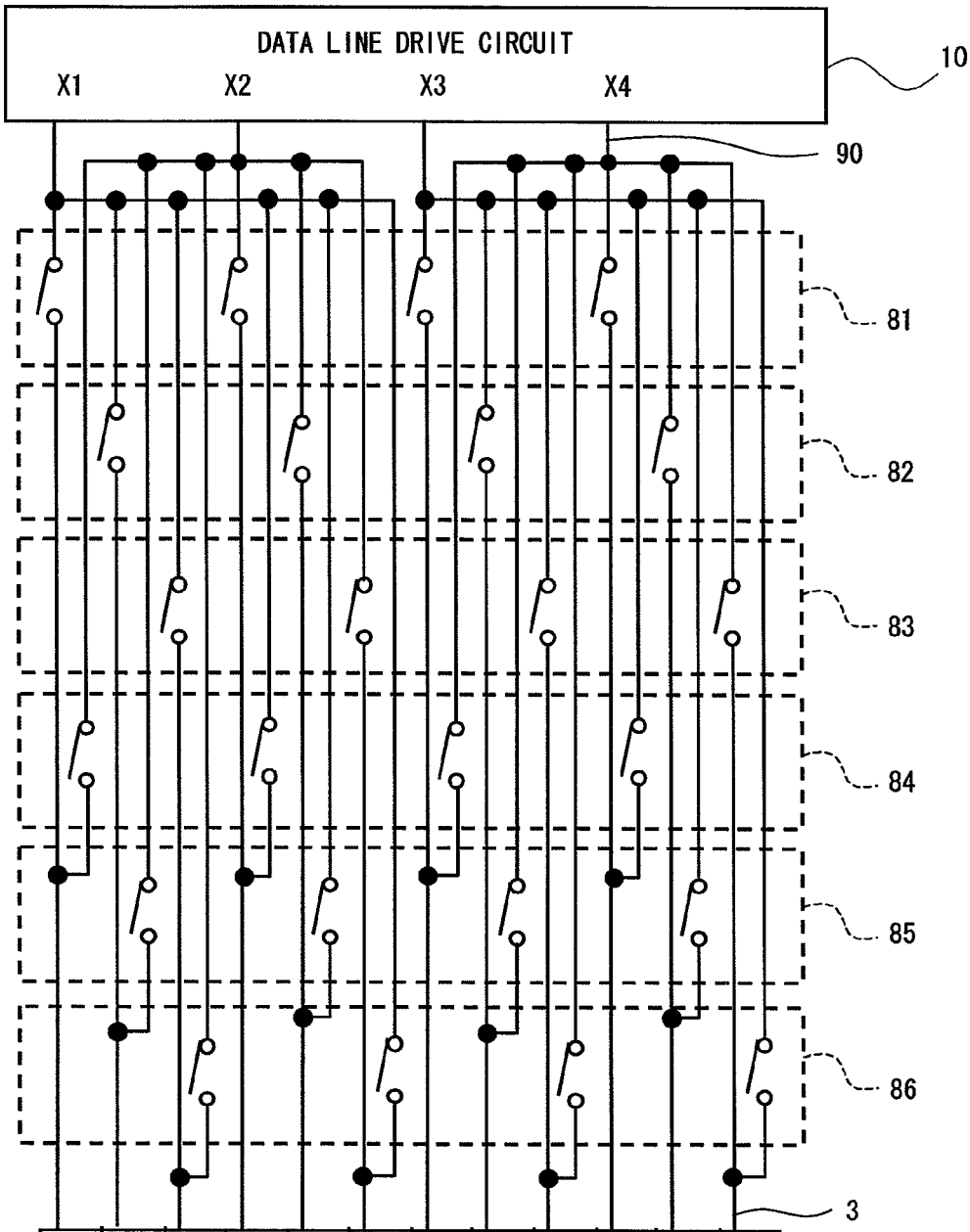
FIG. 13 is a detailed diagram showing a time-sharing selection circuit 8 according to the second embodiment of the present invention.

In the first embodiment, the polarity switching circuit 70 is provided between the precharge circuit 60 and output terminals Xn. However in this embodiment, the precharge circuit 60 is directly connected with output terminals Xn. As illustrated in FIG. 13, a time-sharing selection circuit 8 is comprised of two switches for each data line 3. Each switch is connected to an odd-numbered output terminal and an even-numbered output terminal, including a polarity switching function. Consequently, the number of switches constituting the time-sharing selection circuit 8 on the panel 2 doubled compared to the first embodiment. For example an output terminal X1 is connected to the three data lines (R1, G1, and B1) via switches 81, 82, and 83 as well as being connected to three data lines (R2, G2, and B2) via switches 84, 85, and 86. An output terminal X2, adjacent to an output terminal X1, is connected to the three data lines (R2, G2, and B2) via the switches 81, 82, and 83 as well as being connected to the three data lines (R1, G1, and B1) via the switches 84, 85, and 86.

Also in the first embodiment, a positive or negative polarity analog video signal are outputted from an output terminal Xn of the driver IC1. However this embodiment, a positive polarity analog video signal is outputted from an odd-numbered output terminal, while a negative polarity analog video signal is outputted from an even-numbered output terminal. Not to mention that a circuit may be configured in a way that a negative polarity analog video signal to be outputted from an odd-numbered output terminal, and a positive polarity analog video signal to be outputted from an even-numbered output terminal.

In this embodiment, high-voltage devices such as the power supply circuit 12 is formed on the panel 2, while the data line drive circuit 10 and the signal processing circuit 11 are formed on the driver IC1. In the first embodiment, an analog video signal from a positive or negative D/A conversion circuit is outputted to each data line via three switches, which are a connecting switch 65 or 66, a polarity switching switch 71 or 72 and a switch included in the time-sharing selection circuit 8. On the other hand in this embodiment, by outputting an analog video signal to each of the data line 3 via two switches which are a connecting switch 65 or 66, and a switch included in the time-sharing selection circuit 8, on-resistance of a switch can be lowered, thereby shortening a driving time.

High-voltage devices included in the driver IC makes up only a part of the negative level-shift circuit, thus the size of driver IC1 chip can be smaller.

In similar manner as the first embodiment, switches (61 to 66) constituting the precharge circuit 60 are formed with middle-voltage devices. Manufacturing the switches of the precharge circuit 60 on a semiconductor substrate leads to an ability of a transistor to be superior to the case when manufacturing the switches on the panel 2, a glass substrate etc, by more than one digit, accordingly shortening a precharge time. Shorter precharge time relatively leads to a longer driving time, thus it is possible to increase the number of division and to reduce the number of D/A conversion circuit.

Figure 14:
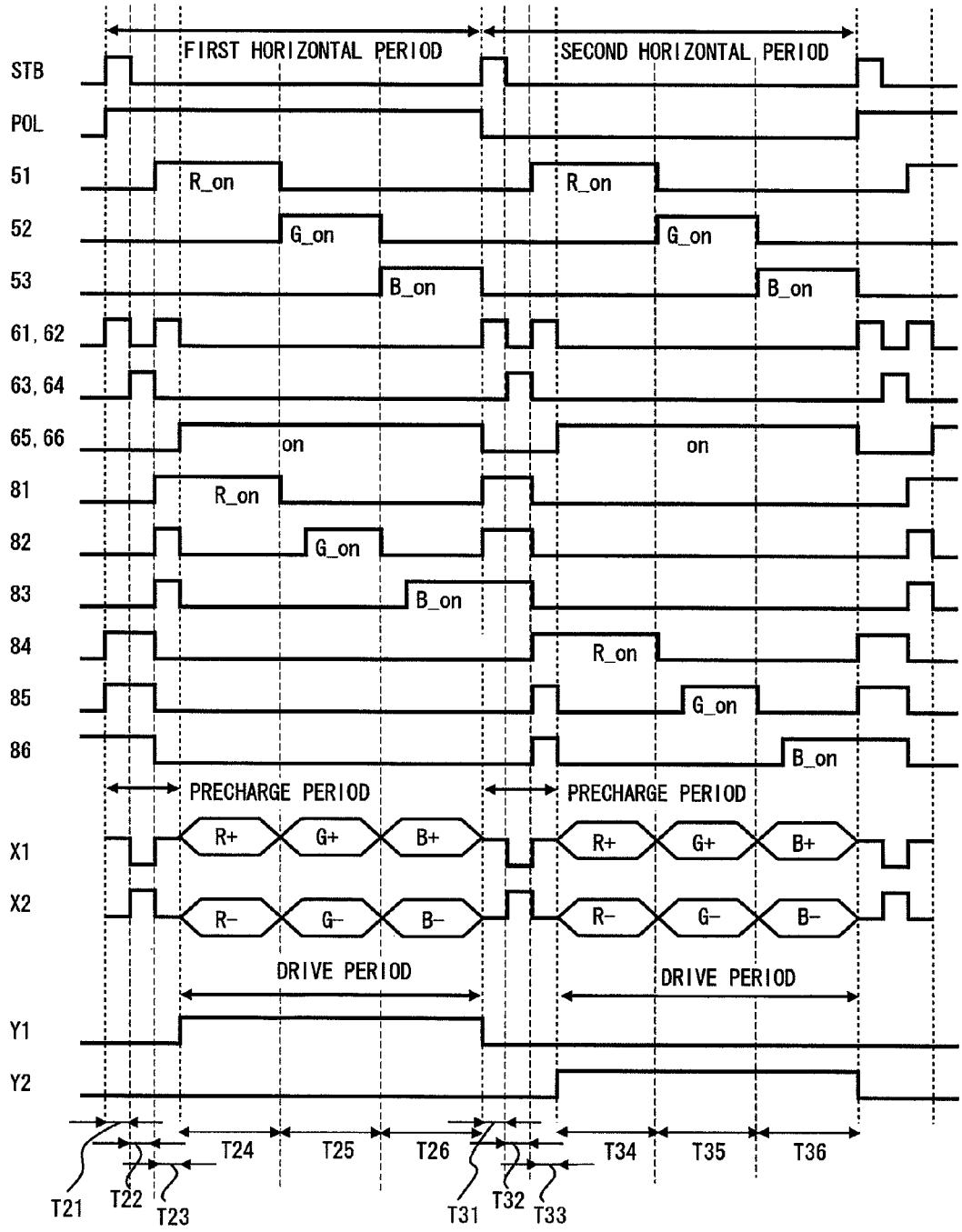
FIG. 14 is a timing chart according to the second embodiment of the present invention.

An operation of the second embodiment is described hereinafter in reference to a timing chart shown in FIG. 14. During a first precharge period T21 in a first horizontal period, charge recycling switches 61, 62, time-sharing switches 84, 85, and 86 are turned on. Then positive polarity charges of data lines (R2, G2, and B2) which are driven to positive polarity in a previous horizontal period are charged to the charge recycling capacity 67, and similarly negative polarity charges of data lines (R1, G1, and B1) which are driven to negative polarity are charged to the charge recycling capacity 68. Then, during a second precharge period T22 in the first horizontal period, precharge switches 63, 64, time-sharing switches 84, 85, and 86 are turned on. After that the data lines (R2, G2, and B2), which are driven to positive polarity during a previous horizontal period, are precharged to a reference voltage (GND), similarly the data lines (R1, G1, and B1), which are driven to negative polarity, are precharged to a reference voltage (GND) in order to neutralize them.

Then, during a third precharge period T23 in the first horizontal period, charge recycling switches 61, 62, time-sharing switches 81, 82, and 83 are turned on. Then positive polarity charges are discharged from the charge recycling capacity 67 to the data lines 3 (R1, G1, and B1) which are precharged to a reference voltage in the second precharge period T22, similarly negative polarity charges are discharged from the charge recycling capacity 68 to the data lines 3 (R2, G2, and B2). This is how a collection and a recycling is achieved for the charges applied as pixel signals to each data lines 3.

Then, during a first drive period T24 in the first horizontal period, connecting switches 65, 66, and the time-sharing switch 81 are turned on, a positive polarity analog video signal is outputted from an output terminal X1 to a data line R1, and a negative polarity analog video signal is outputted from an output terminal X2 to a data line R2. Then, during a second drive period T25 in the first horizontal period, connecting switches 65, 66, and the time-sharing switch 82 are turned on, a positive polarity analog video signal is outputted from the output terminal X1 to a data line G1, and a negative polarity analog video signal is outputted from the output terminal X2 to a data line G2. Then, during a third drive period T26 in the first horizontal period, connecting switches 65, 66, and the time-sharing switch 83 are turned on, a positive polarity analog video signal is outputted from the output terminal X1 to a data line B1, and a negative polarity analog video signal is outputted from the output terminal X2 to a data line B2.

After that, during a first precharge period T31 in a second horizontal period, charge recycling switches 61, 62, time-sharing switches 81, 82, and 83 are turned on. Then positive polarity charges of the data line 3 (R1, G1, and B1), which are driven to positive polarity in the first horizontal period, are charged to the charge recycling capacity 67, and similarly negative polarity charges of the data line 3 (R2, G2, and B2), which are driven to negative polarity in the first horizontal period, are charged to the charge recycling capacity 68. Then, during a second precharge period T32 in the second horizontal period, precharge switches 63, 64, time-sharing switches 81, 82, and 83 are turned on. After that the data lines (R1, G1, and B1), which are driven to positive polarity during a previous horizontal period, are precharged to a reference voltage (GND), similarly the data lines (R2, G2, and B2), which are driven to negative polarity, are precharged to a reference voltage (GND) in order to neutralize them. Then, during a third precharge period T33 in the second horizontal period, charge recycling switches 61, 62, polarity switching switch 71, time-sharing switches 84, 85, and 86 are turned on. After that positive polarity charges are discharged from the charge recycling capacity 67 to the data lines 3 (R2, G2, and B2), which are precharged to a reference voltage in the second precharge period T12, similarly negative polarity charges are discharged from the charge recycling capacity 68 to the data lines 3 (R1, G1, and B1).

Then, during a first drive period T34 in the second horizontal period, connecting switches 65, 66, and the time-sharing switch 84 are turned on, a positive polarity analog video signal is outputted from an output terminal X1 to a data line R2, and a negative polarity analog video signal is outputted from an output terminal X2 to a data line R1. Then, during a second drive period T35 in the second horizontal period, connecting switches 65, 66, and the time-sharing switch 85 are turned on, a positive polarity analog video signal is outputted from the output terminal X1 to a data line G2, and a negative polarity analog video signal is outputted from the output terminal X2 to a data line G1. Then, during a third drive period T36 in the second horizontal period, connecting switches 65, 66, and the time-sharing switch 86 are turned on, a positive polarity analog video signal is outputted from the output terminal X1 to a data line B2, and a negative polarity analog video signal is outputted from the output terminal X2 to a data line B1. As shown in FIG. 8, each pixel is driven so that the pixel is inverted after each frame.

In the first and the second embodiment, a write order to a pixel is explained as R→G→B for convenience. However it is preferable to write G at the end such as in R→B→G or B→R→G because G (Green) has higher sensitivity than R (Red) and B (Blue), considering a leak current of the TFT when the time-sharing switches 81, 82, and 83 are formed with TFTs. Furthermore though the number of division is explained as 3, it does not necessarily have to be 3. However in this case, the number of division is preferably multiple numbers of 3 because RGB is three colors. For example if divided into 6, it is preferable to write pixels with the same color together such as the order of R1→R2→B1→B2→G1→G2 in one D/A conversion circuit. Writing in an order of R1→B1→G1→R2→B2→G2 could result in a display shading because a voltage of pixel R1 fluctuates due to a leak current of a time-sharing switch formed with TFT during a writing time of B1 and G1 between R1 and R2.

Despite that the number of D/A conversion circuit can be reduced as more division is performed, display shading of a panel can be easily identified. To solve this problem, it is preferable to change a write order of pixels with the same color in frames, with four frames as one unit. An example of an application of the write order is for instance; 1st and 2nd frames as (R1→R2→B1→B2→G1→G2) and 3rd and 4th frames as (R2→R1→B2→B1→G2→G1).

Third Embodiment

In the second embodiment, a selection circuit having a polarity switching function and a time-sharing switching function is formed on a panel. A charge recycling circuit may further be formed on the panel.

Figure 15:
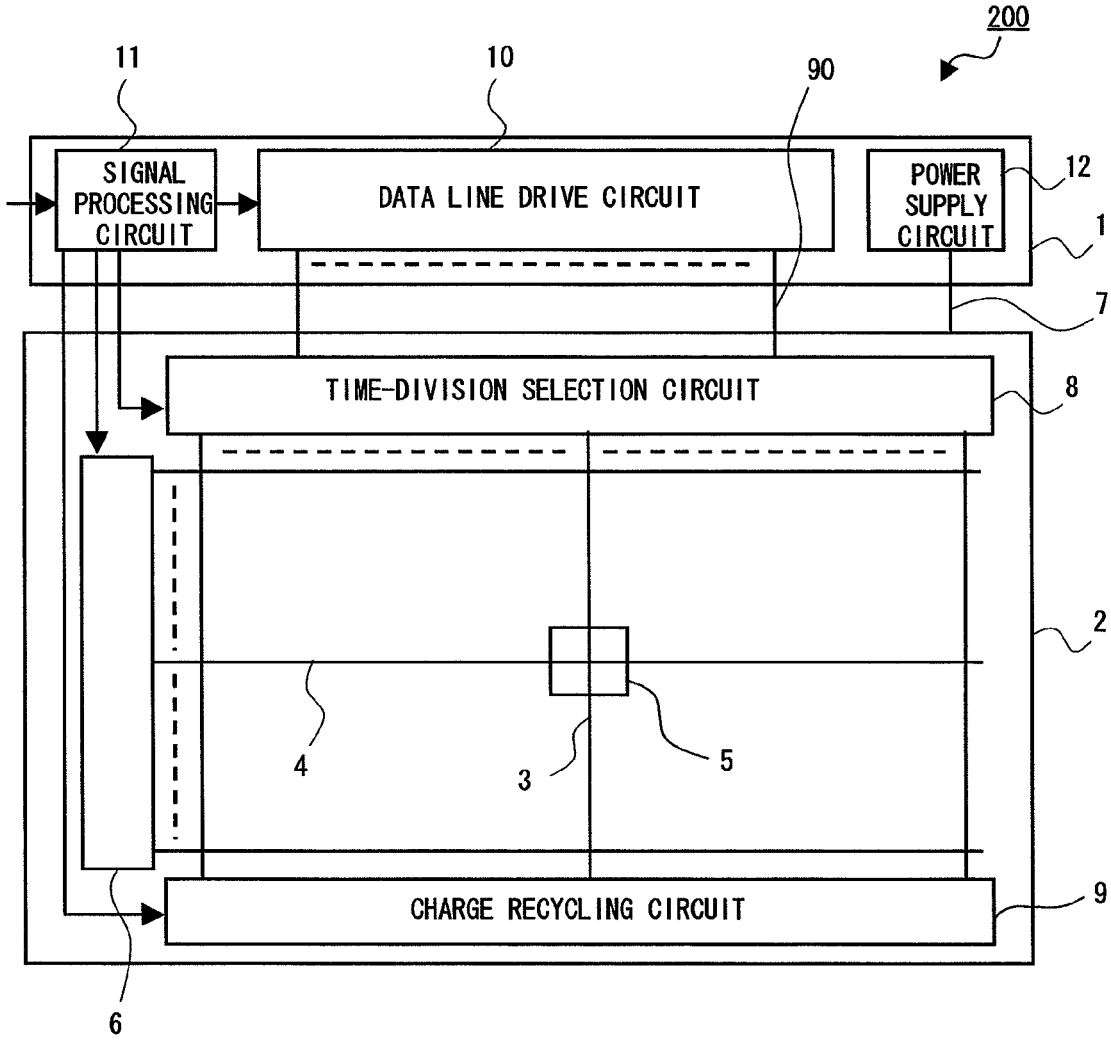
FIG. 15 is a block diagram showing a liquid crystal display according to a third embodiment of the present invention.
Figure 16:
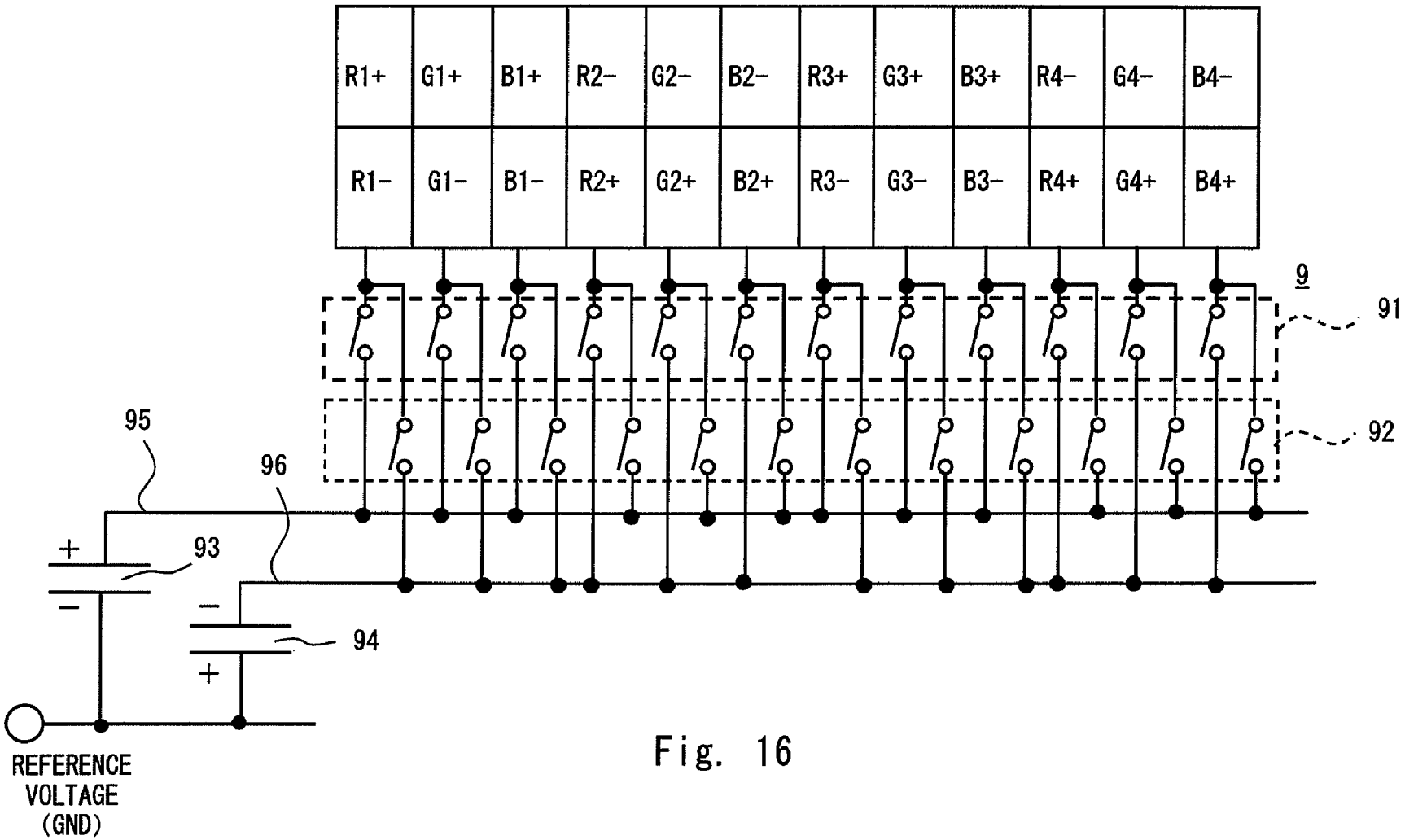
FIG. 16 is a detailed diagram showing a charge recycling circuit 9 according to the third embodiment of the present invention.

FIG. 15 is a block diagram showing a liquid crystal display 200 of this invention. A charge recycling circuit 9 is further formed on a liquid crystal panel substrate 2. A charge recycling circuit 9 is controlled by a signal outputted a the signal processing circuit 11 on a driver IC1. The charge recycling circuit 9 is described hereinafter in detail in reference to FIG. 16. In the charge recycling circuit 9, two charge recycling switches 91 and 92 are provided in parallel to each data lines 3, and other end of the charge recycling switches 91 and 92 are connected to a collection line 95 or a collection line 96 by each data line group. The collection lines 95 and 96 are respectively connected to a charge recycling capacities 93 and 94. The charge recycling switches 91 and 92 are controlled by a polarity signal POL during a first precharge period in a horizontal period. The charge recycling circuit 9 is also operated with VGH and VGL power supply voltages as with the scan line drive circuit 6 and the time-sharing drive circuit 8.

Figure 17:
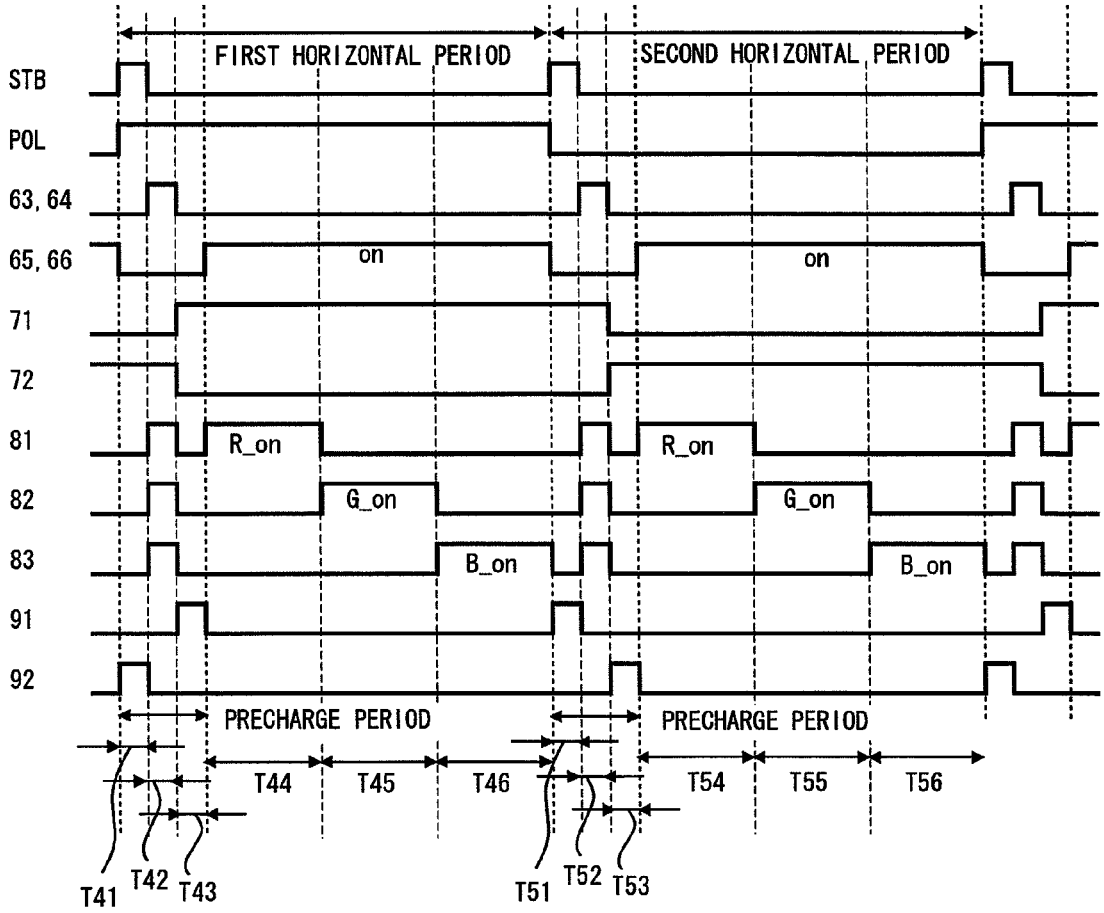
FIG. 17 is a timing chart for a charge recycling according to the third embodiment of the present invention.

An operation of the charge recycling is described in detail in reference to a timing charge of FIG. 17. A polarity signal POL is H in a first horizontal period. During a first precharge period T41 in a first horizontal period, switches 81, 82, and 83 are turned off, the switch 92 is turned on, and charges accumulated in data lines 3 are moved to a charge recycling capacity 93 to collect the charges. Then, during a second precharge period T42 in the first horizontal period, the switch 92 is turned off, the switches 81, 82, and 83 are turned on, precharge switches 63 and 64 are turned on and then precharged to a reference voltage. Then, during a third precharge period T43 in the first horizontal period, the precharge switches 63 and 64 are turned off, the switches 81, 82, and 83 are turned off, the switch 91 is turned on and then charges are moved from a charge recycling capacity 94 to the data lines 3 in order to recycle the charges.

In a second horizontal period, a polarity signal POL becomes L. During a first precharge period T51 in the second horizontal period, the switches 81, 82, and 83 are turned off, the switch 91 is turned on and charges accumulated to the data lines 3 are moved to the charge recycling capacity 94 to collect the charges. Then, during a second precharge period T52 in the second horizontal period, the switch 91 is turned off, the switches 81, 82, and 83 are turned on, precharge switches 63 and 64 inside a driver IC1 are turned on and then precharged to a reference voltage. Then, during a third precharge period T53 in the second horizontal period, the precharge switches 63 and 64 are turned off, the switches 81, 82, and 83 are turned off, the switch 92 is turned on and then charges are moved from a charge recycling capacity 93 to the data lines 3 in order to recycle the charges. The operations in drive periods (T44 to T46 and T54 to T56) are same as the first embodiment.

As with the first and the second embodiment, this embodiment may have a configuration in which a drive circuit having a D/A conversion circuit only on one side of a panel, so that the size of a data line drive circuit can be reduced. Only positive polarity voltage can be applied to the positive polarity D/A conversion circuit 31, while only negative polarity voltage can be applied to the negative polarity D/A conversion circuit 32. Accordingly these devices may be formed with middle-level voltages (5V), allowing to have thinner gate oxides, shorter gate length, and eventually smaller circuit area, as compared to when using high-voltage devices.

In this embodiment, by providing the charge recycling circuit 9 outside a driver IC1, noise to GND inside the driver IC1 can be reduced as well as preventing the noise from spreading to the power supply circuit inside the driver IC1, thereby resulting in a stable com voltage and a satisfactory display.

A reference voltage does not necessarily have to be system ground, although a reference voltage is assumed to be system ground in the first, second, and the third embodiment. It can be a shifted voltage for a feed through error of TFT (thin Film Transistor). More specifically, if the feed through error of TFT is −1V, com voltage will be a system ground and a reference voltage of a driver IC1 will be 1V, with the reference voltage being a virtual GND of the driver IC1. That is, it may be defined as; a positive polarity high power supply voltage VPH=6V, a positive polarity low power supply voltage (virtual GND)=1V, positive polarity high power supply voltage (virtual GND)=1V, and negative polarity low power supply voltage VNL=−4V.

It is apparent that the present invention is not limited to the above embodiment and it may be modified and changed without departing from the scope and spirit of the invention.

What is claimed is:

1. A drive circuit of a liquid crystal display for dividing one horizontal period into at least a number m and outputting a positive or negative polarity analog video signal with different polarities in regard to a reference voltage to data lines of a display unit comprising:

a positive polarity conversion circuit that outputs the positive polarity video signal;

a negative polarity conversion circuit that outputs the negative polarity video signal;

2×m data lines;

a precharge circuit that recycles charges in the 2×m data lines, the precharge circuit disposed between the positive polarity conversion circuit and the 2×m data lines and disposed between the negative polarity conversion circuit and the 2×m data lines;

a plurality of first switches respectively disposed between the precharge circuit and each of the data lines; and a plurality of second switches respectively disposed between the precharge circuit and each of the data lines.

2. The drive circuit of the liquid crystal display according to claim 1, wherein the plurality of first switches and the plurality of second switches are controlled by 2 m control signals.

3. The drive circuit of the liquid crystal display according to claim 2, wherein the positive and the negative conversion circuits are formed on a first substrate, and the first plurality of first switches and the plurality of second switches are formed on a second substrate which is different from the first substrate.

4. The drive circuit of the liquid crystal display according to claim 1, wherein:

the positive polarity conversion circuit operates in a first voltage range that is specified by the reference voltage and a first voltage which is higher than the reference voltage, the negative polarity conversion circuit operates in a second voltage range that is specified by the reference voltage and a second voltage which is lower than the reference voltage, and the plurality of first switches and the plurality of second switches operate in a third voltage range specified by a voltage higher than the first voltage and a voltage lower than the second voltage.

5. The drive circuit of the liquid crystal display according to claim 1, wherein the precharge circuit comprises:

a first connecting switch that connects the positive polarity conversion circuit to at least one of the 2×m data lines; and a second connecting switch that connects the negative polarity conversion circuit to at least one of the 2×m data lines.

6. The drive circuit of the liquid crystal display according to claim 5, wherein:

the positive polarity conversion circuit operates in a first voltage range that is specified by the reference voltage and a first voltage which is higher than the reference voltage, the negative polarity conversion circuit operates in a second voltage range that is specified by the reference voltage and a second voltage which is lower than the reference voltage, the first connecting switch operates in the first voltage range, the second connecting switch operates in the second voltage range, and the plurality of first switches and the plurality of second switches operate in a third voltage range specified by a voltage higher than the first voltage and a voltage lower than the second voltage.

7. The drive circuit of the liquid crystal display according to claim 5, wherein the precharge circuit further comprises:

a first precharge switch and a second precharge switch that precharge the at least one of the 2×m data lines;

a first charge recycling capacitor and a second charge recycling capacitor that recycle the charges in the at least one of the 2×m data lines; and a first charge recycling switch and a second charge recycling switch that connect the at least one of the 2×m data lines to the first charge recycling capacitor and the second charge recycling capacitor.

8. The drive circuit of the liquid crystal display according to claim 7, wherein:

the first precharge switch and the first charge recycling switch operate in the first voltage range, and the second precharge switch and the second charge recycling switch operate in the second voltage range.

9. The drive circuit of the liquid crystal display according to claim 5, wherein the positive polarity conversion circuit outputs the positive polarity video signal to an odd data line among the 2×m data lines through the first connecting switch and a first switch among the plurality of first switches, and wherein the negative polarity conversion circuit outputs the negative polarity video signal to an even data line among the 2×m data lines through the second connecting switch and a second switch among the plurality of second switches.

10. The drive circuit of the liquid crystal display according to claim 5, wherein the positive polarity conversion circuit outputs the positive polarity video signal to an even data line among the 2×m data lines through the first connecting switch and a first switch among the plurality of first switches, and wherein the negative polarity conversion circuit outputs the negative polarity video signal to an odd data line among the 2×m data lines through the second connecting switch and a second switch among the plurality of second switches.

* * * * *